US010948238B2

(12) United States Patent
Hulse et al.

(10) Patent No.: US 10,948,238 B2
(45) Date of Patent: Mar. 16, 2021

(54) TWO-PHASE THERMAL MANAGEMENT DEVICES, SYSTEMS, AND METHODS

(71) Applicant: Roccor, LLC, Longmont, CO (US)

(72) Inventors: Michael Hulse, Erie, CO (US); Steven Isaacs, Loveland, CO (US); Mark Lake, Erie, CO (US); Greg Shoukas, Denver, CO (US); Diego Arias, Bellevue, WA (US); Mario Saldana, Thornton, CO (US)

(73) Assignee: Roccor, LLC, Longmont, CO (US)

( * ) Notice: Subject to any disclaimer, the term of this patent is extended or adjusted under 35 U.S.C. 154(b) by 0 days.

(21) Appl. No.: 16/205,066

(22) Filed: Nov. 29, 2018

(65) Prior Publication Data

US 2019/0204016 A1 Jul. 4, 2019

Related U.S. Application Data

(60) Provisional application No. 62/592,345, filed on Nov. 29, 2017.

(51) Int. Cl.
*F28D 15/00* (2006.01)
*F28D 15/02* (2006.01)
*F28D 15/04* (2006.01)

(52) U.S. Cl.
CPC ..... *F28D 15/0266* (2013.01); *F28D 15/0233* (2013.01); *F28D 15/0275* (2013.01); *F28D 15/046* (2013.01); *F28D 2015/0225* (2013.01)

(58) Field of Classification Search
CPC ..... F28D 15/0266; F28D 15/0233; F28D 15/0275; F28D 15/046; F28D 15/0225
USPC ..... 165/104.26
See application file for complete search history.

(56) References Cited

U.S. PATENT DOCUMENTS 6,058,711 A * 5/2000 Maciaszek ..... F28D 15/043 165/104.26
6,948,556 B1 * 9/2005 Anderson ..... F28D 15/0266 165/104.26
2003/0159809 A1 * 8/2003 Valenzuela ..... F28D 15/0233 165/104.26
2015/0369541 A1 * 12/2015 Dupont ..... F28D 15/0266 165/104.26
2016/0047605 A1 * 2/2016 Mishkinis ..... F28D 15/043 165/104.25

* cited by examiner

*Primary Examiner* — Davis D Hwu
(74) *Attorney, Agent, or Firm* — Wilson Patent Law, LLC

(57) ABSTRACT

Methods, systems, and device for two-phase thermal management are provided in accordance with various embodiments. For example, some embodiments include a two-phase thermal management device that may include: a liquid chamber; one or more inlets configured to deliver a liquid to the liquid chamber; an evaporator chamber; a capillary layer positioned within the evaporator chamber and configured to spread the liquid from the liquid chamber; a liquid manifold configured to deliver the liquid from the liquid chamber to at least the capillary layer or the evaporator chamber; and/or one or more outlets configured to remove at least a vapor or a portion of the liquid from the evaporator chamber. Some embodiments that may include a two-phase thermal management device coupled with at least: a heat exchanger, a pump, a heat recuperator, a pre-heater, and/or a variable volume reservoir. Some embodiments include a two-phase thermal management method.

18 Claims, 25 Drawing Sheets

TWO-PHASE THERMAL MANAGEMENT DEVICES, SYSTEMS, AND METHODS

CROSS-REFERENCES TO RELATED APPLICATIONS

This application is a non-provisional patent application claiming priority benefit of U.S. provisional patent application Ser. No. 62/592,345, filed on Nov. 29, 2017 and entitled "THERMAL MANAGEMENT DEVICES, SYSTEMS, AND METHODS," the entire disclosure of which is herein incorporated by reference for all purposes.

GOVERNMENT LICENSE RIGHTS

This invention was made with Government support under Contract HQ0147-15-C-7130 awarded by the Missile Defense Agency. The Government has certain rights in the invention.

BACKGROUND

Managing heat from different sources, such as solid-state lasers systems, may be addressed in a variety of ways. Solid conduction cooled heat sinks may be utilized but may be bulky and heavy. Pumped, single-phase liquid coolers, which may include microchannel coolers, may accommodate higher heat fluxes, though may be complicated and may suffer reliability concerns. Some two-phase microchannel applications may reduce size and mass, though may face boiling instability issues and may have limited effectiveness under acceleration loads, for example.

There may be a need for new tools and techniques to address thermal management, including applications that may involve high-g forces and/or different orientations.

SUMMARY

Methods, systems, and device for two-phase thermal management are provided in accordance with various embodiments. For example, some embodiments include a two-phase thermal management device that may include: a liquid chamber; one or more inlets configured to deliver a liquid to the liquid chamber; an evaporator chamber; a capillary layer positioned within the evaporator chamber and configured to spread the liquid from the liquid chamber; a liquid manifold configured to deliver the liquid from the liquid chamber to at least the capillary layer or the evaporator chamber; and/or one or more outlets configured to remove at least a vapor or a portion of the liquid from the evaporator chamber.

In some embodiments, the capillary layer includes one or more microstructures. The one or more microstructures may include a wicking structure. The wicking structure may include at least a woven screen, a mesh, or a foam. In some embodiments, the one or more microstructures are bonded to an interior side of an external layer of the two-phase thermal management device; the external layer may be configured to couple with a heat source.

In some embodiments, the capillary layer includes an external layer formed from a metal foil. The capillary layer may include a textured surface. The capillary layer may include multiple pin fins. In some embodiments, the wicking structure includes a surface treatment of an interior surface of an external layer of the two-phase thermal management device In some embodiments, the liquid manifold includes one or more apertures configured to jet impinge the liquid onto the capillary layer. The one or more apertures may include one or more nozzles. The liquid manifold may include a flat plate with multiple pin holes as the one or more apertures.

The liquid manifold may include at least one or more tubes or one or more capillary channels configured to deliver the liquid from the liquid chamber to the capillary layer. At least the one or more tubes or the one or more capillary channels may be configured to deliver the liquid to the capillary layer at an angle normal to an external layer of the two-phase thermal management device, where the external layer may be configured to couple with a heat source.

Some embodiments include one or more pumps coupled with at least the one or more inlets or the one or more outlets. Some embodiments include one or more gravity reservoirs coupled with at least the one or more inlets such that the liquid is gravity fed to the one or more inlets. In some embodiments, the one or more outlets are configured as diverging outlets to allow the vapor to expand from the two-phase thermal management device.

Some embodiments include a heat source coupled to the external layer of the two-phase thermal management device. Some embodiments include a variable-volume reservoir coupled with at least the one or more inlets or the one or more outlets such that at least a constant pressure or a constant temperature is maintained with respect to a boiling point of the liquid.

Some embodiments include a two-phase thermal management system that may include a two-phase thermal management device and a heat exchanger coupled with a one or more outlets of the two-phase thermal management device. The two-phase thermal management device may include: a liquid chamber; one or more inlets configured to deliver a liquid to the liquid chamber; an evaporator chamber; a capillary layer positioned within the evaporator chamber and configured to spread the liquid from the liquid chamber; a liquid manifold configured to deliver the liquid from the liquid chamber to at least the capillary layer or the evaporator chamber; and/or the one or more outlets configured to remove at least a vapor or a portion of the liquid from the evaporator chamber.

In some embodiments, the heat exchanger includes a condenser coupled with the one or more outlets of the two-phase thermal management device to receive vapor from the two-phase thermal management device and reform the liquid. Some embodiments include a pre-heater configured to heat the liquid prior to the liquid being delivered to the one or more inlets of the two-phase thermal management device. The pre-heater may be configured to heat the liquid up to a boiling point of the liquid.

Some embodiments include a variable-volume reservoir coupled with the two-phase thermal management device such at least at a constant temperature or a constant pressure is maintained with respect to a boiling point of the liquid. Some embodiments include a pump configured to pump the liquid to the two-phase thermal management device.

Some embodiments include a heat recuperator configured to remove heat from the vapor coming from the two-phase thermal device and heating the liquid being introduced into the two-phase thermal management device. Some embodiments include a thermal storage configured to store heat from at least the heat exchanger or the heat recuperator. In some embodiments, the thermal storage includes a phase-change material.

Some embodiments include two-phase thermal management method that may include: delivering a liquid to a liquid chamber; directing the liquid from the liquid chamber through a liquid manifold to a capillary layer within an evaporator chamber; spreading the liquid through the capillary layer; heating the liquid spread through the capillary layer to form a vapor; and/or removing the vapor from the evaporator chamber.

Some embodiments include condensing the vapor to form a reformed liquid. Some embodiments include circulating the reformed liquid back to the liquid chamber.

Some embodiments include maintaining at least a constant pressure or a constant temperature with respect to a boiling point of the liquid. Maintaining at least the constant pressure or the constant temperature may include utilizing a variable volume reservoir.

Some embodiments include preheating the liquid prior to delivering the liquid to the liquid chamber. Preheating the liquid may include passing the vapor through a heat recuperator to remove heat from the vapor and heat the liquid prior to delivering the liquid to the liquid chamber.

In some embodiments, delivering the liquid to the liquid chamber includes pumping the liquid to deliver the liquid to the liquid chamber. In some embodiments, delivering the liquid to the liquid chamber includes utilizing gravity to deliver the liquid to the liquid chamber. Some embodiments include coupling a heat source with the evaporator chamber proximal to the capillary layer.

Some embodiments include methods, systems, and/or devices as described in the specification and/or shown in the figures.

The foregoing has outlined rather broadly the features and technical advantages of embodiments according to the disclosure in order that the detailed description that follows may be better understood. Additional features and advantages will be described hereinafter. The conception and specific embodiments disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of different embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
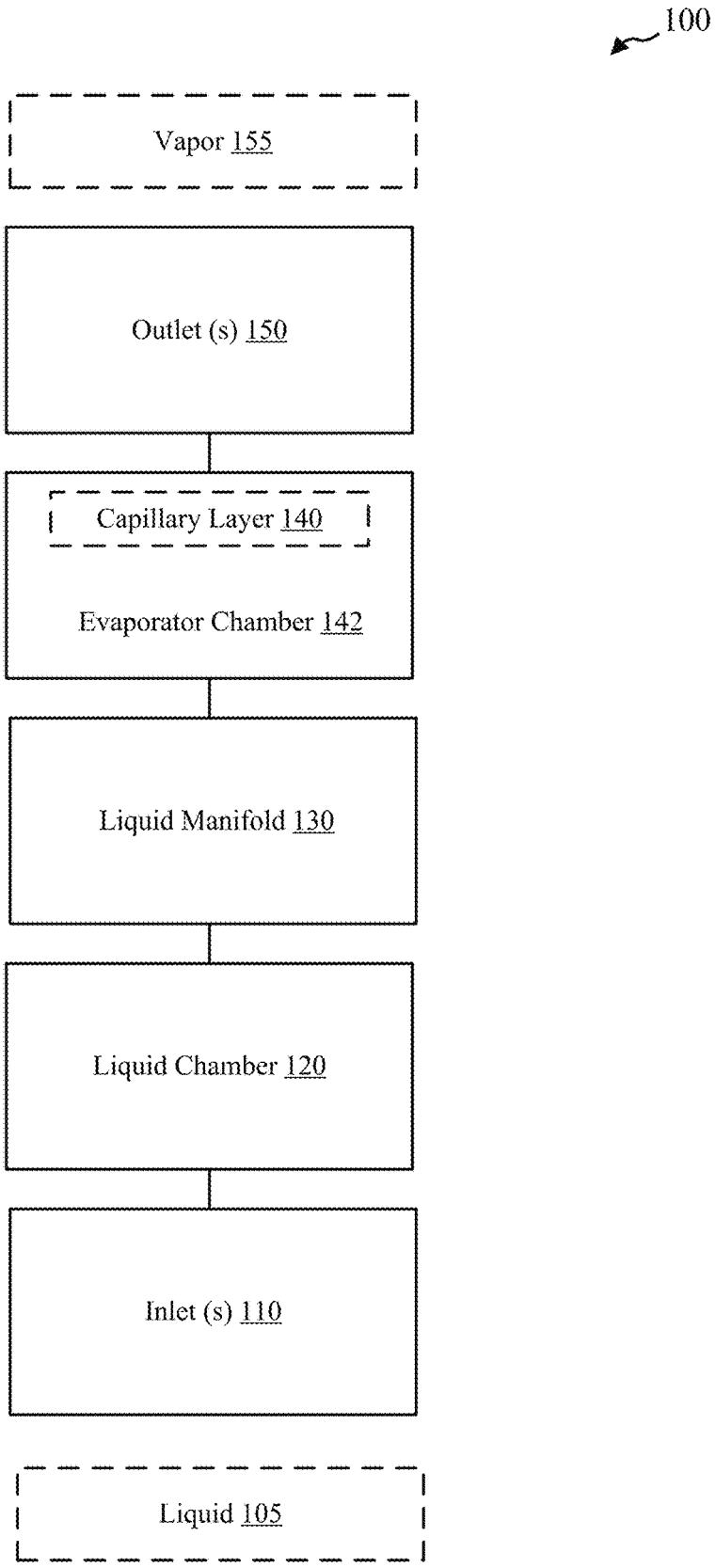
FIG. 1A shows a device in accordance with various embodiments.

This description provides embodiments, and is not intended to limit the scope, applicability, or configuration of the disclosure. Rather, the ensuing description will provide those skilled in the art with an enabling description for implementing embodiments of the disclosure. Various changes may be made in the function and arrangement of elements.

Thus, various embodiments may omit, substitute, or add various procedures or components as appropriate. For instance, it should be appreciated that the methods may be performed in an order different than that described, and that various stages may be added, omitted or combined. Also, aspects and elements described with respect to certain embodiments may be combined in various other embodiments. It should also be appreciated that the following systems, devices, and methods may individually or collectively be components of a larger system, wherein other procedures may take precedence over or otherwise modify their application.

Methods, systems, and devices for two-phase thermal management are provided in accordance with various embodiments. For example, some embodiments include a two-phase cold plate technology that may provide improved thermal management for high heat components under varying dynamic loads. For example, some embodiments may be utilized for cooling in laser diodes for airborne Directed Energy (DE) systems, though the tools and techniques may be applicable in general to other thermal management applications. Some embodiments provide a lightweight and simple thermal management device, which may allow high rate cooling through flow boiling during high-acceleration maneuvers onboard an aircraft, for example. Some embodiments enable extremely high cooling efficiencies to be achieved in devices that self-regulate the distribution and flow rate of cooling fluid in response to varying heat fluxes and g-loads. Some embodiments are designed to produce a heat transfer coefficient of ~10,000 W/m2–K, though other heat transfer coefficients may be produced with other designs in accordance with various embodiments. Some embodiments provide auto-regulation of flow rates for a range of cooling fluxes up to 16 W/cm2 (~100 W/in2), for example. Other heat fluxes may be applicable to some embodiments. Some embodiments provide similar cooling performance in horizontal, vertical, and upside-down orientations in 1-g, which may indicate stable thermal management for present and/or future tactical aircraft, for example. Some embodiments thus provide self-regulating, two-phase cooling technology in response to time-varying heat fluxes and gravity orientations, which may meet the high heat flux and g-load requirements of current and/or future DE systems and/or other thermal management situations.

Some embodiments may address problems that may be faced with higher duty cycle solid-state laser systems, such as a directed energy systems, where solid conduction cooled heat sinks may be prohibitively bulky and heavy, particularly for an airborne system. In addition, while actively pumped single-phase liquid microchannel coolers may accommodate higher heat fluxes, these systems are generally complicated and may suffer from reliability concerns. Also, cooling a 500 kW heat load, for example, may involve hundreds of gallons per minute in flow rate and may involve prohibitively large and heavy pumps, plumbing and coolant reservoirs. By contrast, some embodiments provide two-phase thermal management systems that may dramatically reduce flow rates and the system overhead size and mass.

However, two-phase thermal management systems that may employ flow boiling in microchannels may face some problems. Microchannels may be located in close proximity with thermal loads (with limited thermal path to the working fluid) and may create increased surface area for better heat transfer coefficients, for example. However, systems that employ flow boiling in a channel may be of limited effectiveness under aircraft acceleration loads due to sloshing and pooling of fluid and inhibited flow, giving rise to hot spots or decreasing critical heat transfer characteristics. In some cases, parallel microchannels may also experience boiling instabilities.

Some embodiments may addressees these problems in a variety of ways, including the use of a capillary layer that may spread a working fluid close to a heat source and may be kept stable under different loads. Some embodiments may be capable of cooling high heat fluxes and may also enable passive flow control of the working fluid in response to varying heat flux and under variable g-loads via the fluid-delivery capillary microstructure provided in accordance with various embodiments. Some embodiments may be integrated directly onto different heat sources, such as diode laser bars or fiber coupled diode laser modules, which may remove waste heat at a considerable distance from the laser head, for example, and may considerably reduce the mass and volume of the integrated thermal management system.

Turning now to FIG. 1A, a device 100 is provided in accordance with various embodiments. Device 100 may be referred to as a two-phase thermal management device. In some embodiments, device 100 may be referred to as an active two-phase thermal management device. Device 100 may include: a liquid chamber 120; one or more inlets 110 configured to deliver a liquid 105 to the liquid chamber 120; an evaporator chamber 142; a capillary layer 140 positioned within the evaporator chamber 142 and configured to spread the liquid 105 from the liquid chamber 120; a liquid manifold 130 configured to deliver the liquid 105 from the liquid chamber 120 to at least the capillary layer 140 or the evaporator chamber 142; and/or one or more outlets 150 configured to remove at least a vapor 155 or a portion of the liquid 105 from the evaporator chamber 142.

In some embodiments, the capillary layer 140 includes one or more microstructures. The one or more microstructures may include a wicking structure. The wicking structure may include at least a woven screen, a mesh, or a foam. In some embodiments, the one or more microstructures are bonded to an interior side of an external layer of the two-phase thermal management device 100; the external layer may be configured to couple with a heat source. In some embodiments, the wicking structure includes a surface treatment of an interior surface of an external layer of the two-phase thermal management device 100.

In some embodiments, the capillary layer 140 includes an external layer formed from a metal foil. The capillary layer 140 may include a textured surface. The capillary layer 140 may include multiple pin fins.

In some embodiments, the liquid manifold 130 includes one or more apertures configured to jet impinge the liquid 105 onto the capillary layer 140. The one or more apertures may include one or more nozzles. The liquid manifold 130 may include a flat plate with multiple pin holes as the one or more apertures.

In some embodiments, the liquid manifold 130 includes at least one or more tubes or one or more capillary channels configured to deliver the liquid 105 from the liquid chamber 120 to the capillary layer 140. At least the one or more tubes or the one or more capillary channels may be configured to deliver the liquid 105 to the capillary layer 140 at an angle normal to an external layer of the two-phase thermal management device 100, where the external layer may be configured to couple with a heat source.

Some embodiments include one or more pumps coupled with at least the one or more inlets 110 or the one or more outlets 150. Some embodiments include one or more gravity reservoirs coupled with at least the one or more inlets 110 such that the liquid 105 is gravity fed to the one or more inlets 110. In some embodiments, the one or more outlets 150 are configured as diverging outlets to allow the vapor 155 to expand from the two-phase thermal management device 100. A variety of liquids 105 may be utilized including, but not limited to, acetone, water, oils, and/or refrigerants.

Some embodiments include a heat source coupled to the external layer of the two-phase thermal management device 100. Some embodiments include a variable-volume reservoir coupled with at least the one or more inlets 110 or the one or more outlets 150 such that at least a constant pressure or a constant temperature is maintained with respect to a boiling point of the liquid 105.

Figure 1B:
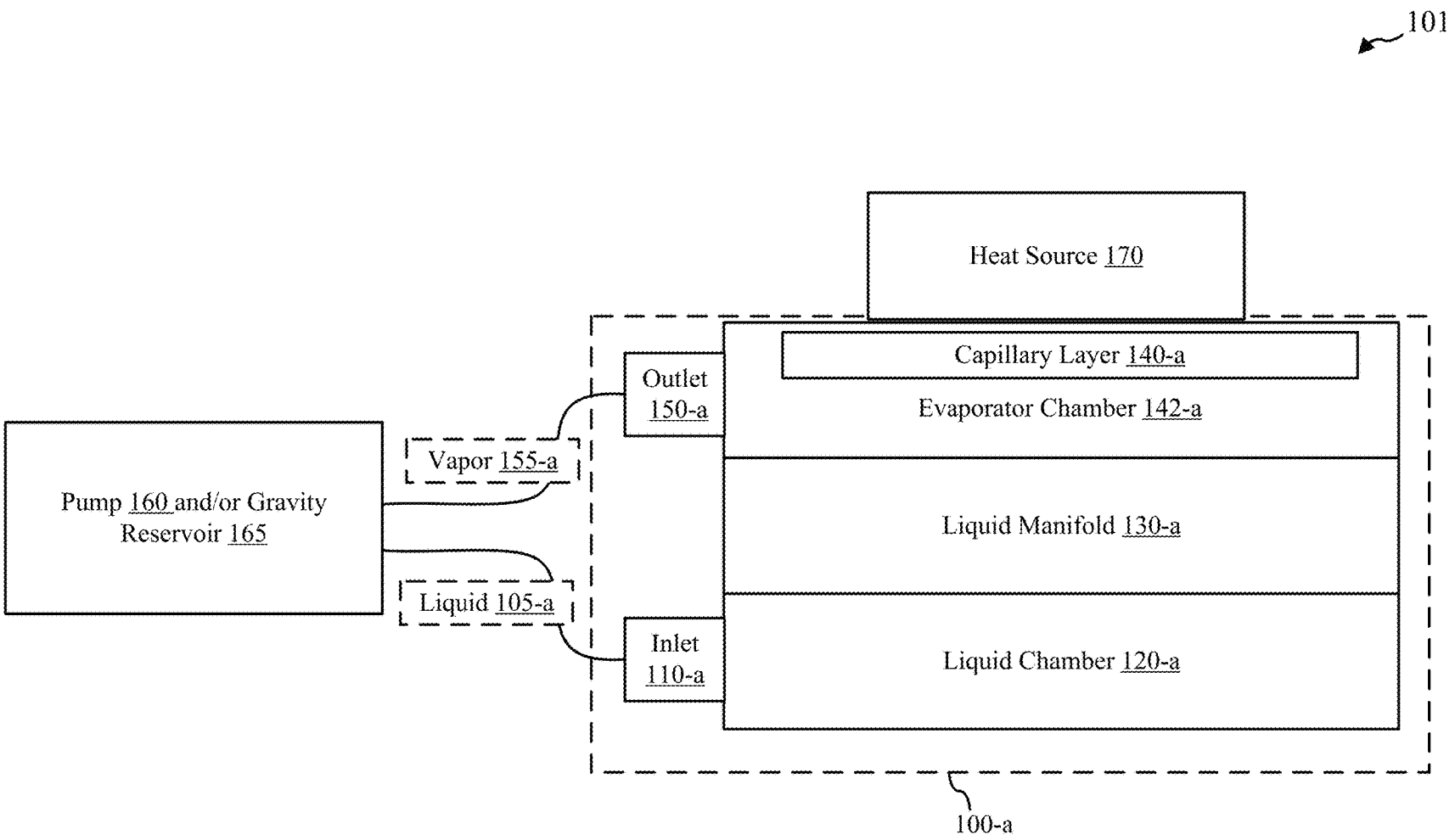
FIG. 1B shows a system and/or device in accordance with various embodiments.

FIG. 1B shows an example of a two-phase thermal management system 101 in accordance with various embodiments. System 101 may include a two-phase thermal management device 100-*a*, which may be an example of device 100 of FIG. 1A. Two-phase thermal management device 100-*a* may be coupled with a heat source 170 such that heat may be absorbed from the heat source 170 by the two-phase thermal management device 100-*a*.

Two-phase thermal management device 100-*a* may include a pump 160 that may deliver a liquid 105-*a* to inlet 110-*a*; the liquid 105-*a* may be delivered to the pump 160 from outlet 150-*a*. The pump 160 may facilitating forming an active system. Some embodiments may utilize gravity to deliver the liquid 105-*a* to the inlet 110-*a*; for example, a gravity reservoir 165-*a* may facilitate delivering the liquid 105-*a*. The liquid 105-*a* may be delivered to liquid chamber 120-*a*, from where the liquid manifold 130-*a* may deliver the liquid to the capillary layer 140-*a*. The liquid manifold 130-*a* may utilize a variety of configurations to deliver the liquid 105-*a* to the capillary layer 140-*a*. For example, some embodiments may utilize tubes or other capillary channels. Some embodiments may configure the liquid manifold 130-*a* to jet impinge the liquid 105-*a* onto the capillary layer 140-*a*; for example, some embodiments may utilize nozzles or other apertures that may provide for unconstrained delivery of the liquid 105-*a* to the capillary layer 140-*a*.

The capillary layer 140-*a* may be disposed with an evaporator chamber 142-*a*. Heat may be absorbed from the heat source 170 through the liquid spread through the capillary layer 140-*a*; the liquid 105-*a* may then evaporate from the capillary layer 140-*a* to form a vapor 155-*a*. In some cases, the vapor 155-*a* may expand into open portions of the vapor chamber 142-*a*. Vapor 155-*a* and/or excess liquid 105-*b* may leave through outlet 150-*a* and return to pump 160 and/or gravity reservoir 165, which may result in vapor and/or excess liquid being removed from the capillary layer 140-*a*.

Figure 1C:
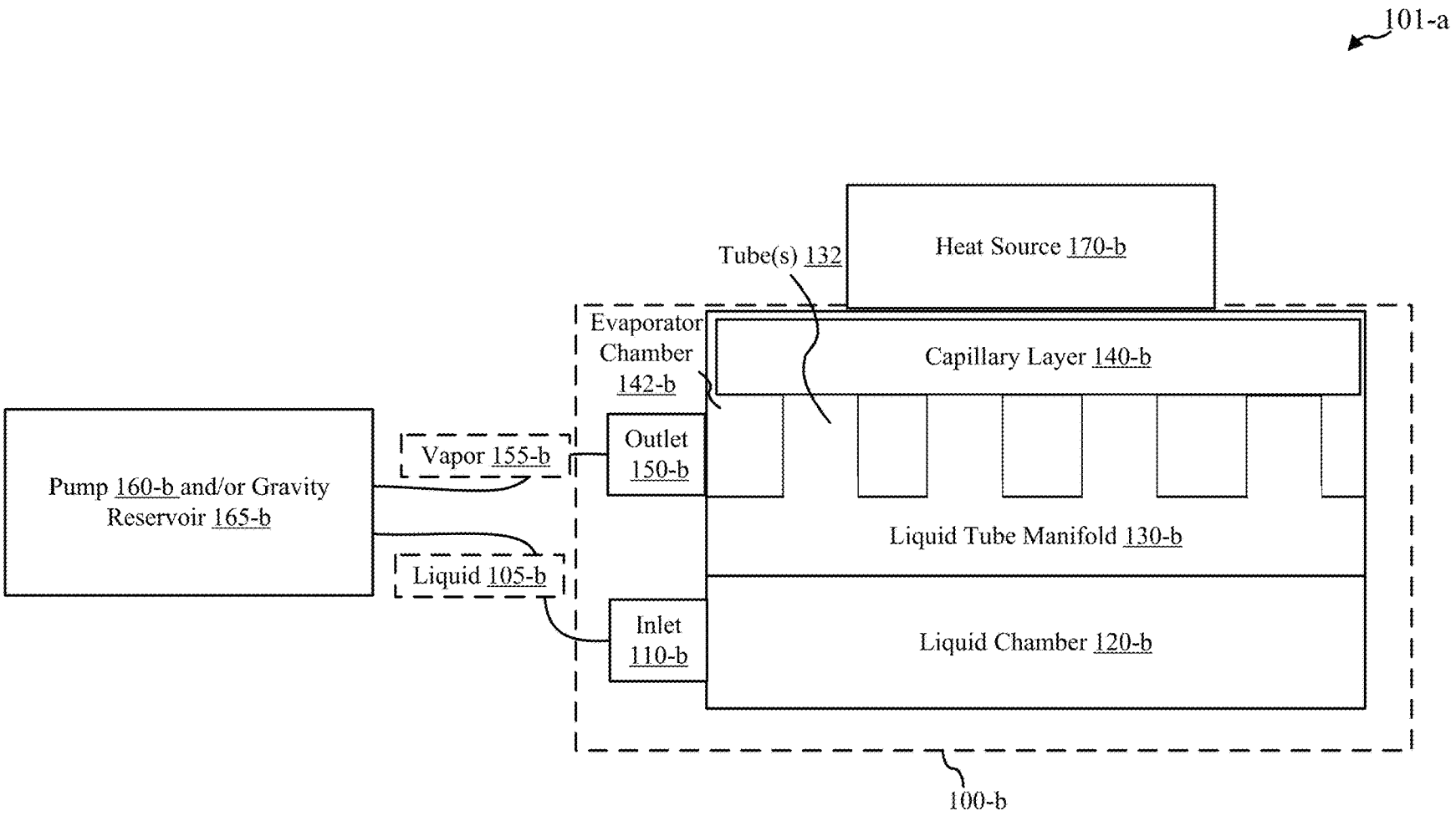
FIG. 1C shows a system and/or device in accordance with various embodiments.

FIG. 1C shows another example of a two-phase thermal management device 100-*b* in accordance with various embodiments as part of a two-phase thermal management system 101-*a*, which may be an example of system 101 of FIG. 1B. Device 100-*b* may be an example of device 100 of FIG. 1A and/or device 100-*a* of FIG. 1B. Two-phase thermal management device 100-*b* may be coupled with a heat source 170-*b* such that heat may be absorbed from the heat source 170-*b* by the two-phase thermal management device 100-*b*. Similar to device 100-*a* of FIG. 1B, two-phase thermal management device 100-*b* may include a pump 160-*b* and/or gravity reservoir 165-*b* that may deliver and/or receive a liquid 105-*b* from inlet 110-*b* and/or outlet 150-*b*. The liquid 105-*b* may be delivered to liquid chamber 120-*b*, from where the liquid tube manifold 130-*b* may distribute the liquid to the capillary layer 140-*b*. The capillary layer 140-*b* may be disposed with a vapor chamber 142-*b*.

For example, the liquid tube manifold 130-*b* may include one or more tubes 132 (or capillary channels) that may be configured to deliver the liquid 105-*b* from the liquid chamber 120-*b* to the capillary layer 140-*b*. The one or more tubes 132 may be configured to deliver the liquid to the capillary layer 140-*b* at an angle normal to an external layer of the thermal management device 100-*b*. In some embodiments, the one or more tubes 132 may utilize capillary action to deliver the liquid 105-*b* to the capillary layer 140-*b*. The external layer of device 100-*b* may be configured to couple with the heat source 170-*b*. Heat may be absorbed from the heat source 170-*b* through the liquid 105-*b* spread through the capillary layer 140-*b*; the liquid 105-*b* may then evaporate from the capillary layer 140-*b* to form a vapor 155-*b*. In some cases, the vapor 155-*b* may expand into open portions of the vapor chamber 142-*b* in some embodiments. Vapor 155-*a* and/or excess liquid 105-*b* may leave through outlet 150-*b* and return to pump 160-*b* and/or gravity reservoir 165-*b*, which may result in vapor and/or excess liquid being removed from the capillary layer 140-*b*.

Figure 1D:
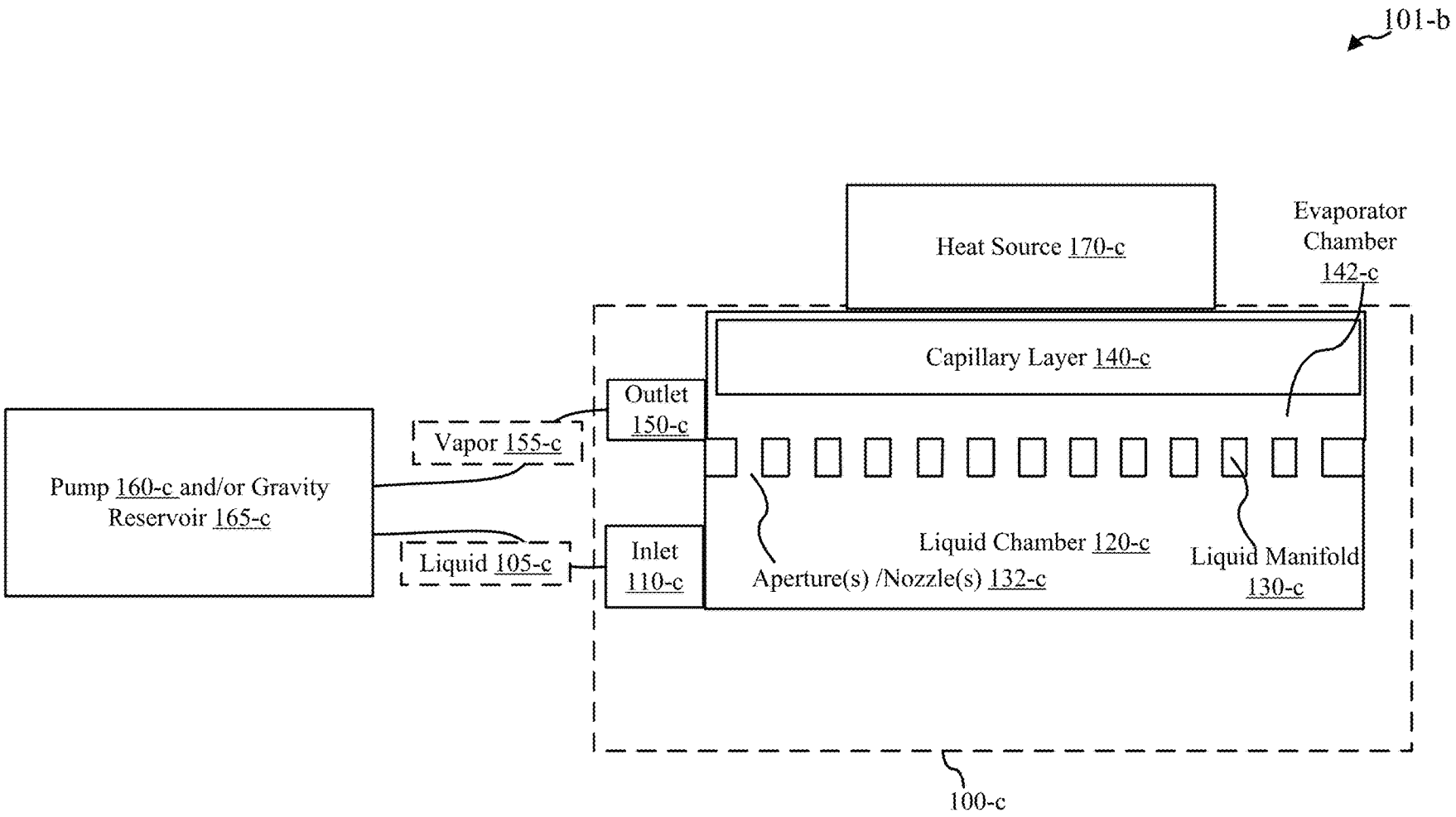
FIG. 1D shows a system and/or device in accordance with various embodiments.

FIG. 1D shows another example of a two-phase thermal management device 100-*c* in accordance with various embodiments as part of a two-phase thermal management system 101-*b*, which may be an example of system 101 of FIG. 1B. Device 100-*c* may be an example of device 100 of FIG. 1A and/or device 100-*a* of FIG. 1B. Two-phase thermal management device 100-*c* may be coupled with a heat source 170-*c* such that heat may be absorbed from the heat source 170-*c* by the two-phase thermal management device 100-*c*. Similar to device 100-*a* of FIG. 1B, two-phase thermal management device 100-*c* may include a pump 160-*c* and/or gravity reservoir 165-*c* that may deliver and/or receive a liquid 105-*c* from inlet 110-*c* and/or outlet 150-*c*. The liquid 105-*c* may be delivered to liquid chamber 120-*c*, from where the liquid manifold 130-*c* may distribute the liquid to the capillary layer 140-*c*. The capillary layer 140-*c* may be disposed with a vapor chamber 142-*c*.

In particular, the liquid manifold 130-*c* may include one or more apertures or nozzles 132-*c* that may be configured to deliver the liquid from the liquid chamber 120-*c* to the capillary layer 140-*c*. The one or more apertures and/or nozzles 132-*c* may be configured to jet impinge the liquid 105-*c* onto the capillary layer 140-*c*. Heat may be absorbed from the heat source 170-*c* through the liquid 105-*c* spread through the capillary layer 140-*c*; the liquid 105-*c* may then evaporate from the capillary layer 140-*c* to form a vapor 155-*c*. In some cases, the vapor 155-*c* may expand into open portions of the vapor chamber 142-*c* in some embodiments. Vapor 155-*a* and/or excess liquid 105-*c* may leave through outlet 150-*c* and return to pump 160-*c* and/or gravity reservoir 165-*c*, which may result in vapor and/or excess liquid being removed from the capillary layer 140-*c*.

Figure 2:
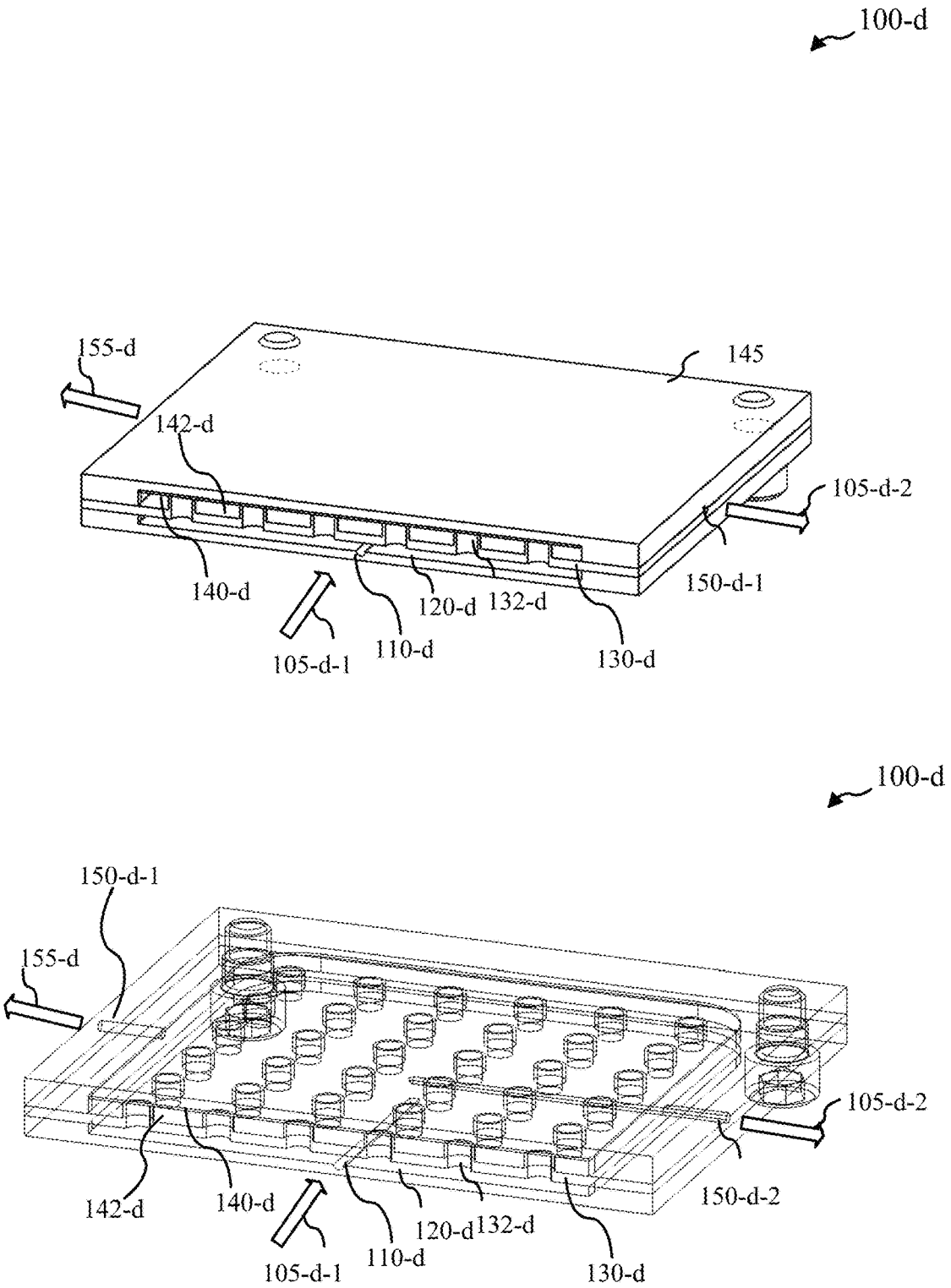
FIG. 2 shows a device in accordance with various embodiments.

Turning now to FIG. 2, two perspectives of a two-phase thermal management device 100-*d* are provided in accordance with various embodiments. Device 100-*d* may be an example of aspects of device 100 of FIG. 1A, device 100-*a* of FIG. 1B, and/or device 100-*b* of FIG. 1C. The top image of device 100-*d* may represent an external view (with a side removed to review the layered structure) while the bottom image of device 100-*d* may represent an internal view.

FIG. 2 may show liquid 105-*d*-1 entering device 100-*d*, such as into a liquid layer or liquid chamber 120-*d*, through inlet 110-*d*. The liquid 105-*d*-1 may then be distributed to the capillary layer 140-*d*, which may include a wicking structure. The liquid 105-*d* may be distributed to the capillary layer 140-*d* through a liquid manifold 130-*d*. The liquid manifold 130-*d* may include one or more tubes and/or capillary channels 132-*d*. The one or more tubes 132-*d* may be configured to deliver the liquid through capillary action to the capillary layer 140-*d* at an angle normal to an external layer 145 of the two-phase thermal management device 100-*d*; the external layer 145 may be configured to couple with a heat source. With liquid spread through capillary layer 140-*d*, heat may be absorbed and the liquid 105-*d* may evaporate to form a vapor 155-*d* from the capillary layer 140-*d*. Vapor 155-*d* may then be removed from the device 100-*d* through outlet 150-*d*-1, which may be an example of a diverging outlet. In some embodiments, excess liquid 105-*d*-2 may be removed through outlet 150-*d*-2. In some embodiments, the capillary layer 140-*d* may be disposed within a vapor chamber 142-*d* that may be coupled with the outlets 150-*d*-1 and/or 150-*d*-2.

Figure 3:
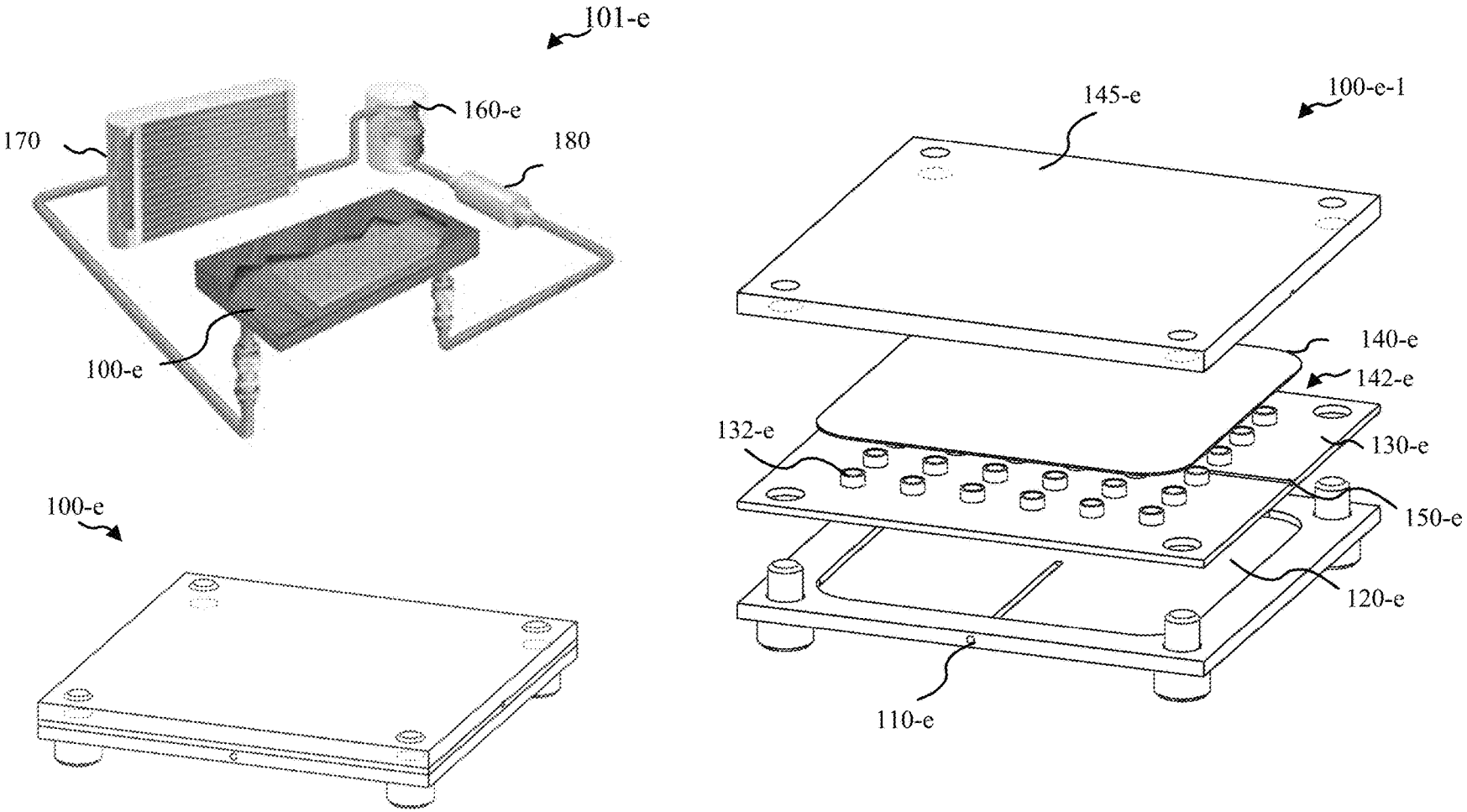
FIG. 3 shows a system and/or device in accordance with various embodiments.

Turning now to FIG. 3, a system 101-*e* along with a two-phase thermal management device 100-*e* (and an exploded cross-section view 100-*e*-1) are provided in accordance with various embodiments. Device 100-*e* may be an example of aspects of device 100 of FIG. 1A, device 100-*a* of FIG. 1B, device 100-*b* of FIG. 1C, and/or device 100-*d* of FIG. 2. System 101-*b* may be an example of system 101 of FIG. 1B and/or system 101-*a* of FIG. 1C.

In some embodiments, device 100-*e* may be referred to as a cold plate. Device 100-*e* (as illustrated with respect to exploded view 100-*e*-1) may include a manifold 130-*e* of tubes or capillary channels 132-*e* that may deliver liquid to a fluid wick 140-*e*, or evaporator, located against the heated surface where evaporation may occur. The liquid-delivery manifold 130-*e* may work in tandem with the wick 140-*e* to continually wet the entire heated surface 145-*e* of the cold plate as liquid is boiled off; in some embodiments, the heated surface 145-*e* may be an external layer of the device 100-*e*. In some embodiments, natural capillary pumping forces within the liquid-delivery manifold 130-*e* may be designed to automatically meter the flow rate and distribute liquid under a wide range of heat fluxes and g-loadings. Some embodiments may also utilize a pump 160-*e*, as may be shown in system 101-*e*. Device 100-*e*-1 may also include a liquid chamber 120-*e* and an evaporator chamber 142-*e*. An inlet 110-*e* may introduce liquid into the liquid chamber 120-*e*; an outlet 150-*e* may allow vapor to be removed from the evaporator chamber 142-*e*. System 101-*e* may show device 100-*e* in one context that may include a condenser or heat exchanger 170, which may be utilized to remove heat from the vapor and/or condenser the vapor back to a liquid. System 101-*e* may also include a pre-heater 180, which may be utilized to pre-heat the liquid being delivered to the device 100-*e*. For example, the pre-heater 180 may pre-heat the liquid to a boiling point of the liquid.

Figure 4A:
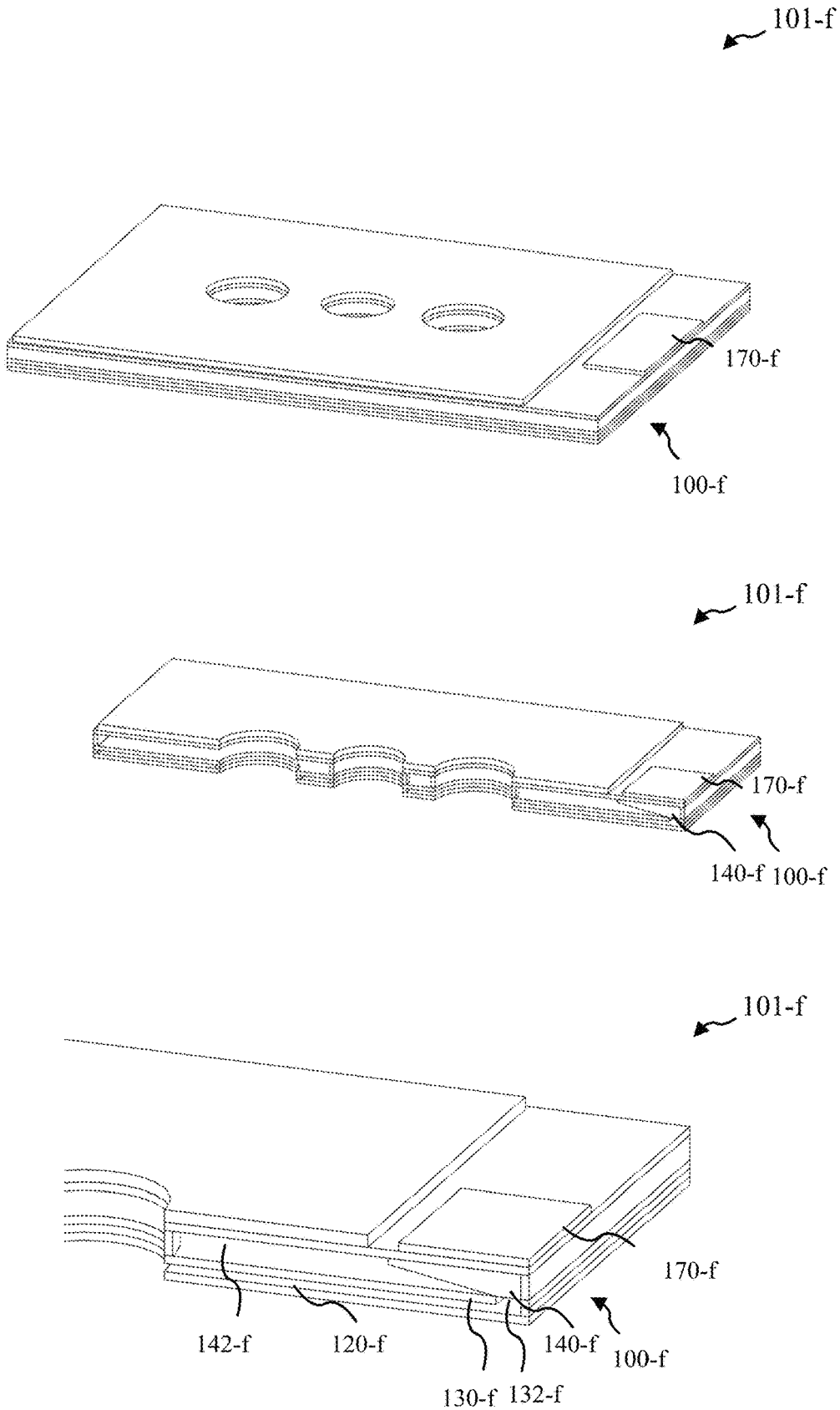
FIG. 4A shows a system and/or device in accordance with various embodiments.
Figure 4B:
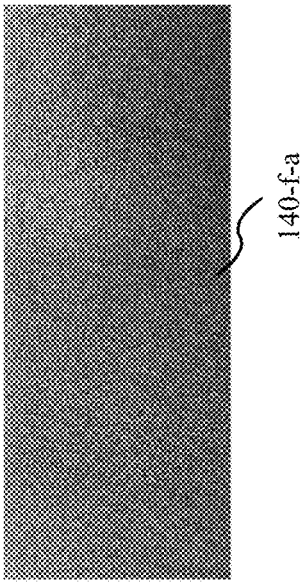
FIG. 4B shows a system and/or device in accordance with various embodiments.
Figure 4B:
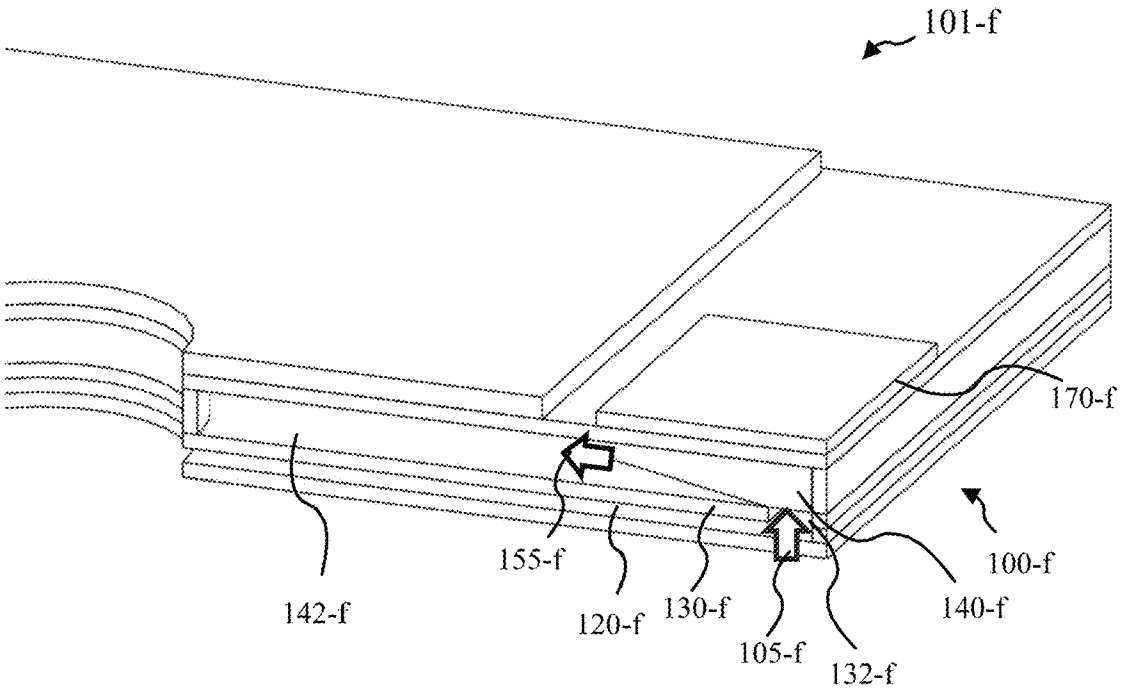

Turning now to FIG. 4A and FIG. 4B, different perspectives on a two-phase thermal management system 101-*f* are provided in accordance with various embodiments. System 101-*f* may include a two-phase thermal management device 100-*f* and heat source 170-*f*. Thermal management device 100-*g* may be an example of device 100 of FIG. 1A, device 100-*a* of FIG. 1B, and/or device 100-*c* of FIG. 1D. Device 100-*f* may include a liquid chamber 120-*f* that may deliver a liquid to a liquid manifold 130-*f* that may have one or more apertures or openings 132-*f* that direct the liquid to a capillary layer 140-*f* disposed over the opening and within an evaporator chamber 142-*f*. The heat source 170-*f* may be positioned over the capillary layer 140-*f*.

As may be shown in particular with respect to FIG. 4B in particular, a liquid 105-*f* may move through a liquid chamber 120-*f* to one or more openings 132-*f*, which may be part the liquid manifold 130-*f*. From the one or more openings 132-*f*, the liquid 105-*f* may be direct to the capillary layer 140-*f*; the liquid 105-*f* may jet impinge upon the capillary layer 140-*f* in some cases. The heat source 170-*f* may heat the liquid in the capillary layer 140-*f*; the resulting vapor 155-*f* may then move away from the heat source 170-*f* through evaporator chamber 142-*f*. System 101-*f* may be applicable for different heat sources including, but not limited to, laser diodes. FIG. 4B may also highlight an example of the capillary layer 140-*f*-*a*, which may include a foam structure, which may include a copper foam. Other capillary structures may be utilized, including, but not limited to, meshes or woven screens.

Figure 4C:
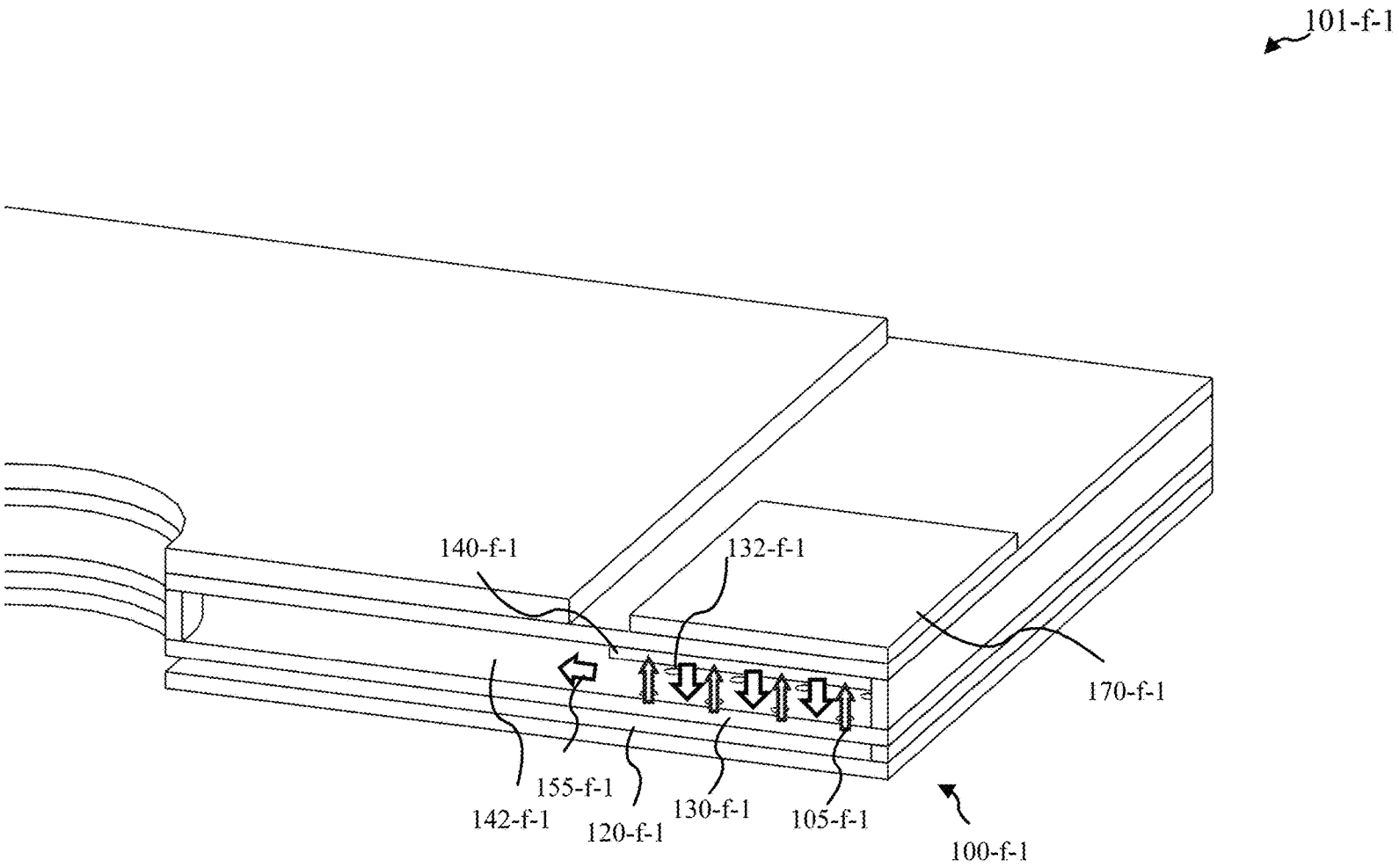
FIG. 4C shows a system and/or device in accordance with various embodiments.

FIG. 4C shows a variation of the previous device 100-*f*, now referred to a two-phase thermal device 100-*f*-1 as part of system 101-*f*-1 in accordance with various embodiments. In particular, device 100-*f*-*a* may include multiple openings or apertures 132-*f*-1; a liquid 105-*f*-1 may move through a liquid chamber 120-*f*-1 to the multiple openings 132-*f*-1, which may be part a liquid manifold 130-*f*-1. From the multiple openings 132-*f*-1, the liquid 105-*f*-1 may be jet impinged upon the capillary layer 140-*f*-1. The heat source 170-*f*-1 may heat the liquid in the capillary layer 140-*f*-1; the resulting vapor 155-*f*-1 may then move away from the heat source 170-*f*-1 through evaporator chamber 142-*f*-1. In some embodiments, the capillary layer 140-*f*-1 may be sized and positioned based on the footprint of the heat source 170-*f*-1. System 101-*f*-1 may be applicable for different heat sources including, but not limited to, laser diodes.

FIG. 5A, FIG. 5B, FIG. 5C, and FIG. 5D provide several perspectives of another example of a two-phase thermal management device 100-*g* in accordance with various embodiments. Device 100-*g* may be an example of device 100 of FIG. 1A, FIG. 1B, and/or FIG. 1D.

Figure 5A:
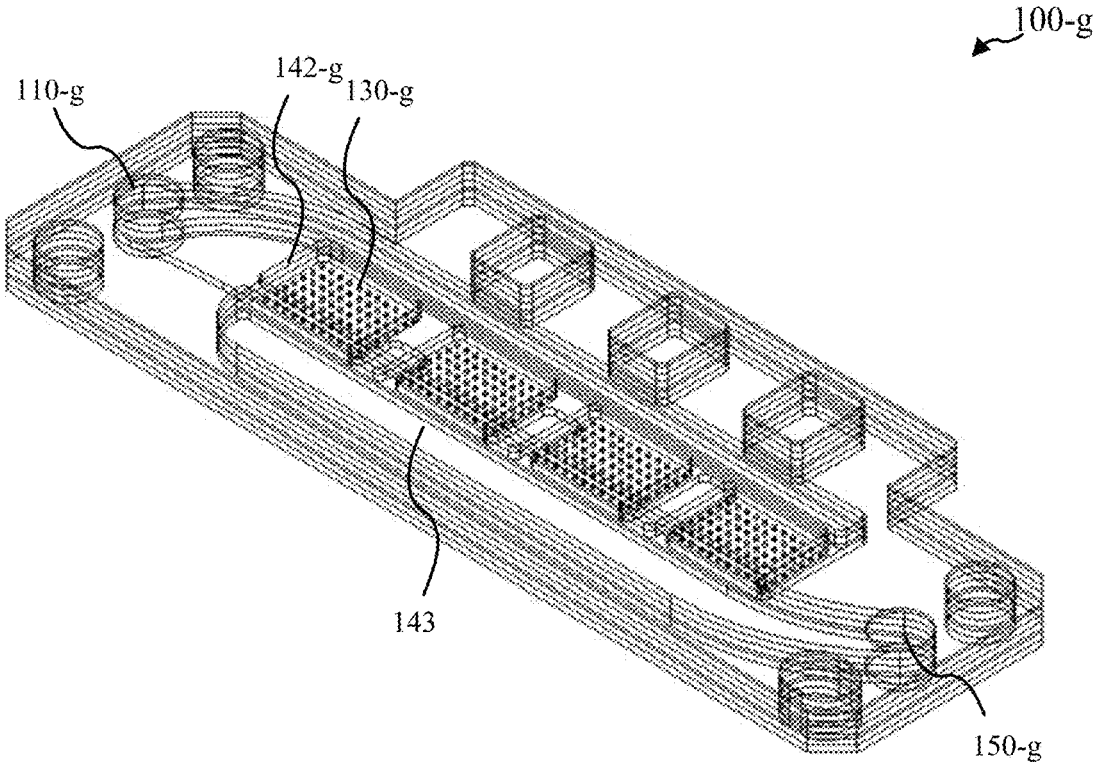
FIG. 5A shows a device in accordance with various embodiments.
Figure 5B:
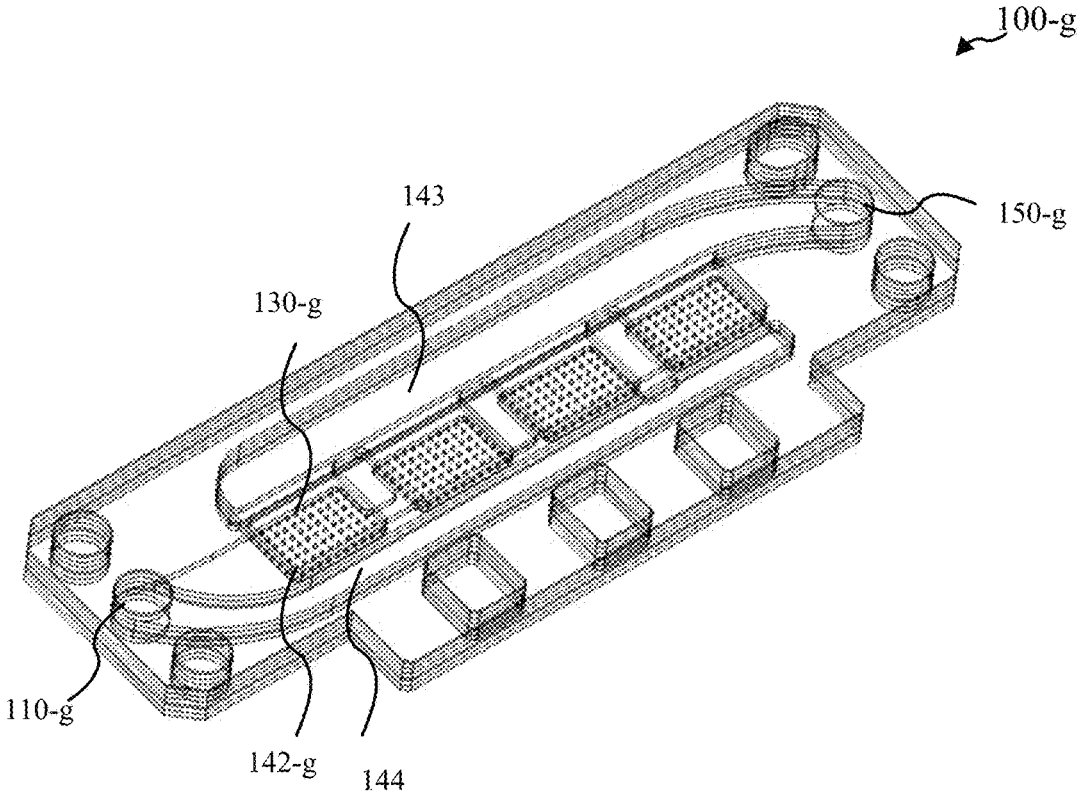
FIG. 5B shows a device in accordance with various embodiments.
Figure 5C:
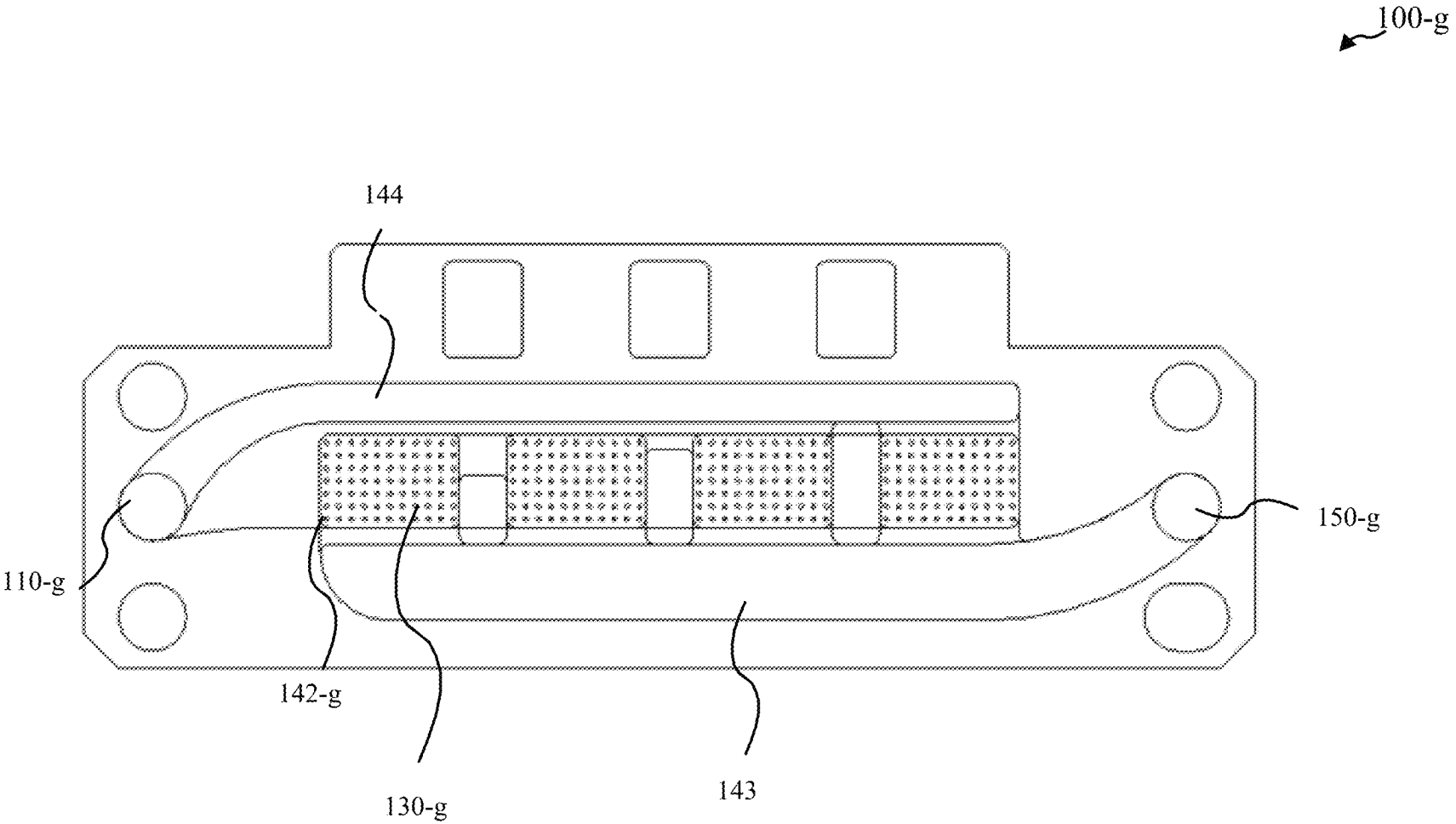
FIG. 5C shows a device in accordance with various embodiments.

FIG. 5A and FIG. 5B show a transparent top view and a transparent bottom view respectively of device 100-*g*. In particular, FIG. 5A shows inlet port 110-*g* and outlet port 150-*g*. Also, an evaporator chamber 142-*g*, with a vapor plenum 143, in particular may be shown. The evaporator chamber 142-*g* may be configured to facilitate cooling of one or more diodes, for example; in this example, four diodes or other heat sources may be positioned with respect to portions of the liquid manifold 130-*g*, which may include four nozzle regions. One or more capillary layers may be positioned within evaporator chamber 142-*g*, but have been removed in order to reveal other components, such as the multiple impinging nozzles (shown as pin holes) of a liquid manifold 130-*g*. The bottom view of FIG. 5B may show inlet port 110-*g* along with outlet port 150-*g*. In addition, the liquid chamber 120-*g*, which may include a liquid plenum 144, may be shown. Impinging nozzles of the liquid manifold 130-*g* may be shown also. FIG. 5C shows a transparent straight down top view that may show the vapor plenum 143, inlet port 110-*g*, outlet port 150-*g*, impinging nozzles of liquid manifold 130-*g*, and liquid plenum 144.

Figure 5D:
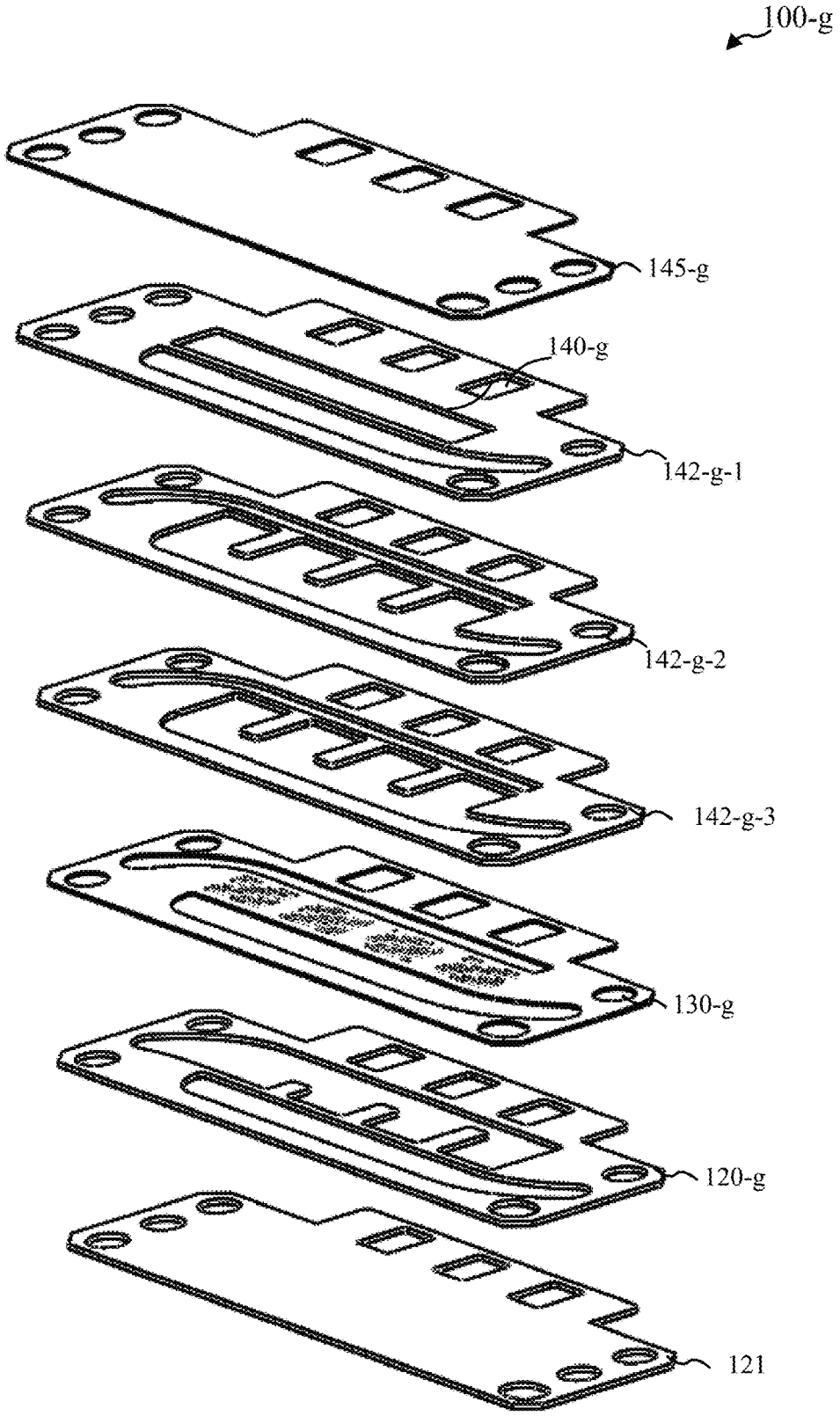
FIG. 5D shows a device in accordance with various embodiments.

FIG. 5D may show an exploded view of device 100-*g*. Working from the bottom up with respect to the exploded view of FIG. 5D, a bottom plate 121 may form the bottom surface of device 100-*g* and may form the lower boundary of a liquid chamber, which may be formed within liquid plenum layer 120-*g*. A nozzle plate 130-*g* may form the liquid manifold, which may include numerous nozzles that may be formed as pin holes in some embodiments. The nozzle plate 130-*g* may be formed such that liquid that passes through the multiple nozzles may be jet impinged on to the wicking or other capillary structure 140-*g* of device 100-*g*. Above the nozzle plate 130-*g* may be found several layers that may form the evaporator chamber, including vapor space plates 142-*g*-1, 142-*g*-2, and 142-*g*-3. The vapor space plate 142-*g*-1 may also include one or more capillary structures 140-*g* to providing wicking. Device 100-*g* may also include a top plate 145-*g* that may provide an external layer of the device 100-*g* that may couple with a heat source.

FIG. 6A, FIG. 6B, FIG. 6C, and FIG. 6D provide several perspectives on another example of a two-phase thermal management device 100-*h* in accordance with various embodiments. Device 100-*h* may be an example of devices 100 of FIG. 1A, FIG. 1B, and/or FIG. 1D.

Figure 6A:
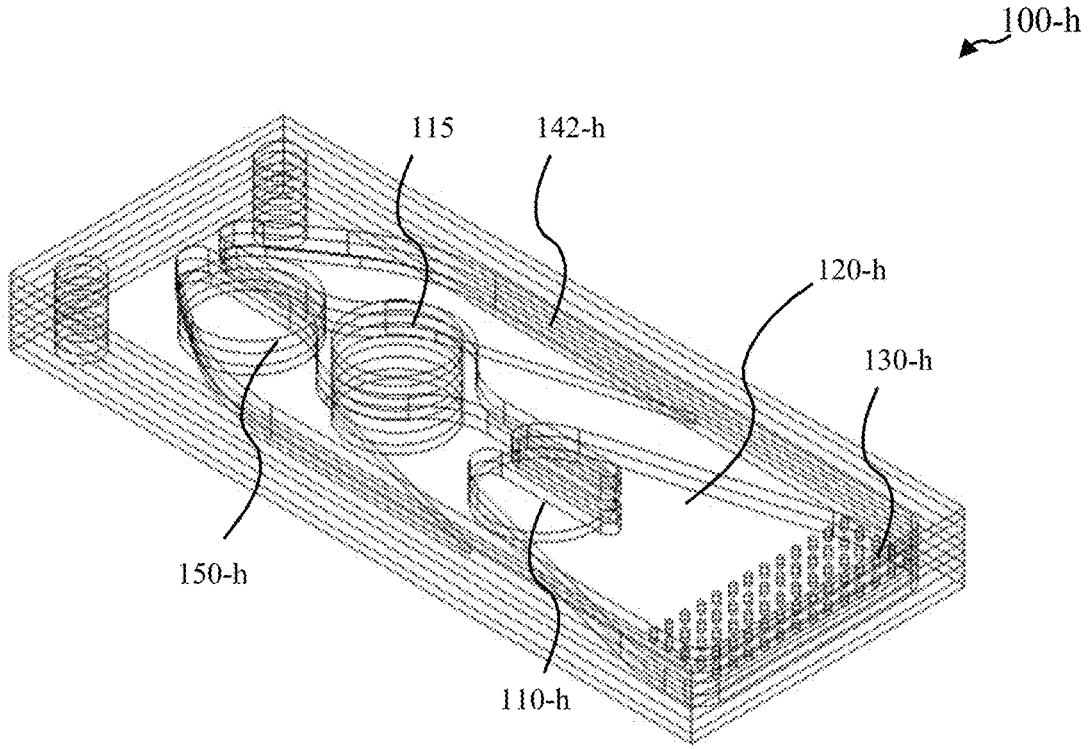
FIG. 6A shows a device in accordance with various embodiments.
Figure 6B:
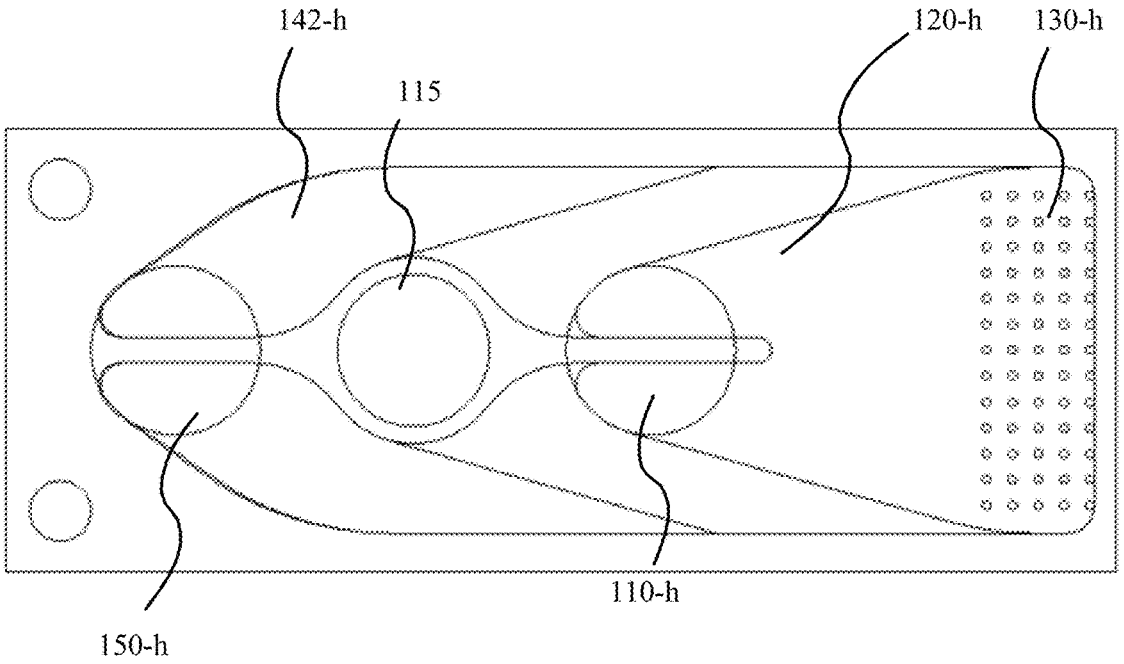
FIG. 6B shows a device in accordance with various embodiments.

FIG. 6A shows transparent top view of device 100-*h*. In particular, FIG. 6A shows inlet port 110-*h* and outlet port 150-*h*. Also, portions of the evaporator chamber 142-*h*, with a vapor plenum in particular may be shown. The one or more evaporator chambers 142-*h* may be configured to facilitate cooling of one or more diodes, for example. Other heat sources may be cooled utilizing device 100-*h*. Spray nozzles of a liquid manifold 130-*h* may be shown also and may jet impinge fluid upon a capillary layer (not shown). Device 100-*h* may also include a mounting thru hole 115. FIG. 6B shows a straight down transparent top view of device 100-*h*.

Figure 6C:
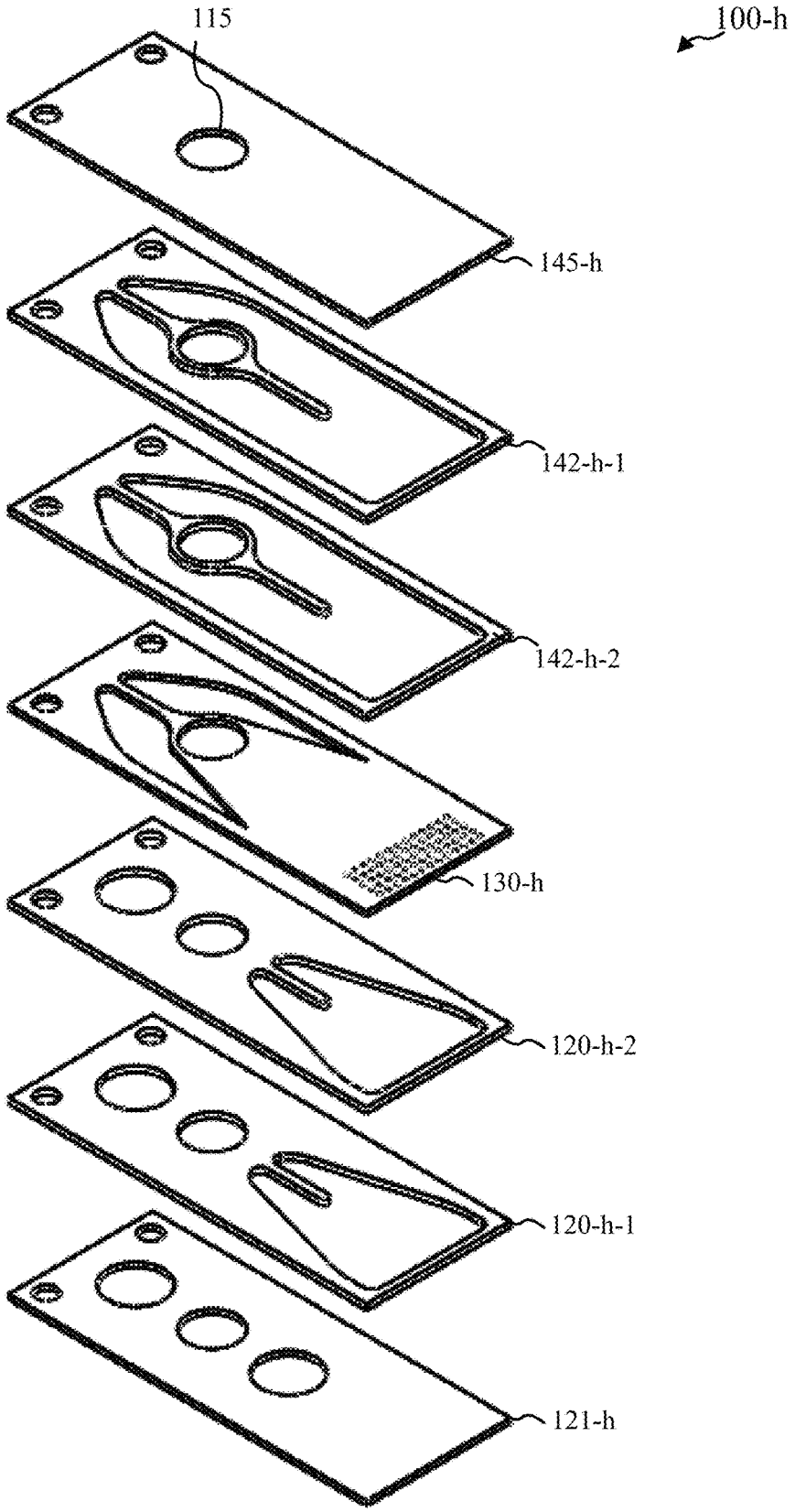
FIG. 6C shows a device in accordance with various embodiments.

FIG. 6C may show an exploded view of device 100-*h*. Working from the bottom up with respect to the exploded view of FIG. 6C, a bottom plate 121-*h* may form the bottom surface of device 100-*h* and may form the lower boundary of a liquid chamber, which may be formed within liquid plenum layers 120-*h*-1, 12-*h*-2. A nozzle plate 130-*h* may form the liquid manifold, which may include numerous nozzles that may be formed as pin holes in some embodiments. The nozzle plate 130-*h* may be formed such that liquid that passes through the multiple nozzles is jet impinged on to the wicking or other capillary structure of device 100-*h*. Above the nozzle plate 130-*h* may be found several layers that may form the evaporator chamber, including vapor space plates 142-*h*-1 and 142-*h*-2. The vapor space plate 144-*h*-1 may also include one or more capillary structures to providing wicking. Device 100-*h* may also include a top plate 145-*h* that may provide an external layer of the device 100-*h* that may couple with a heat source. Mounting thru hole 115 may also be shown.

Figure 6D:
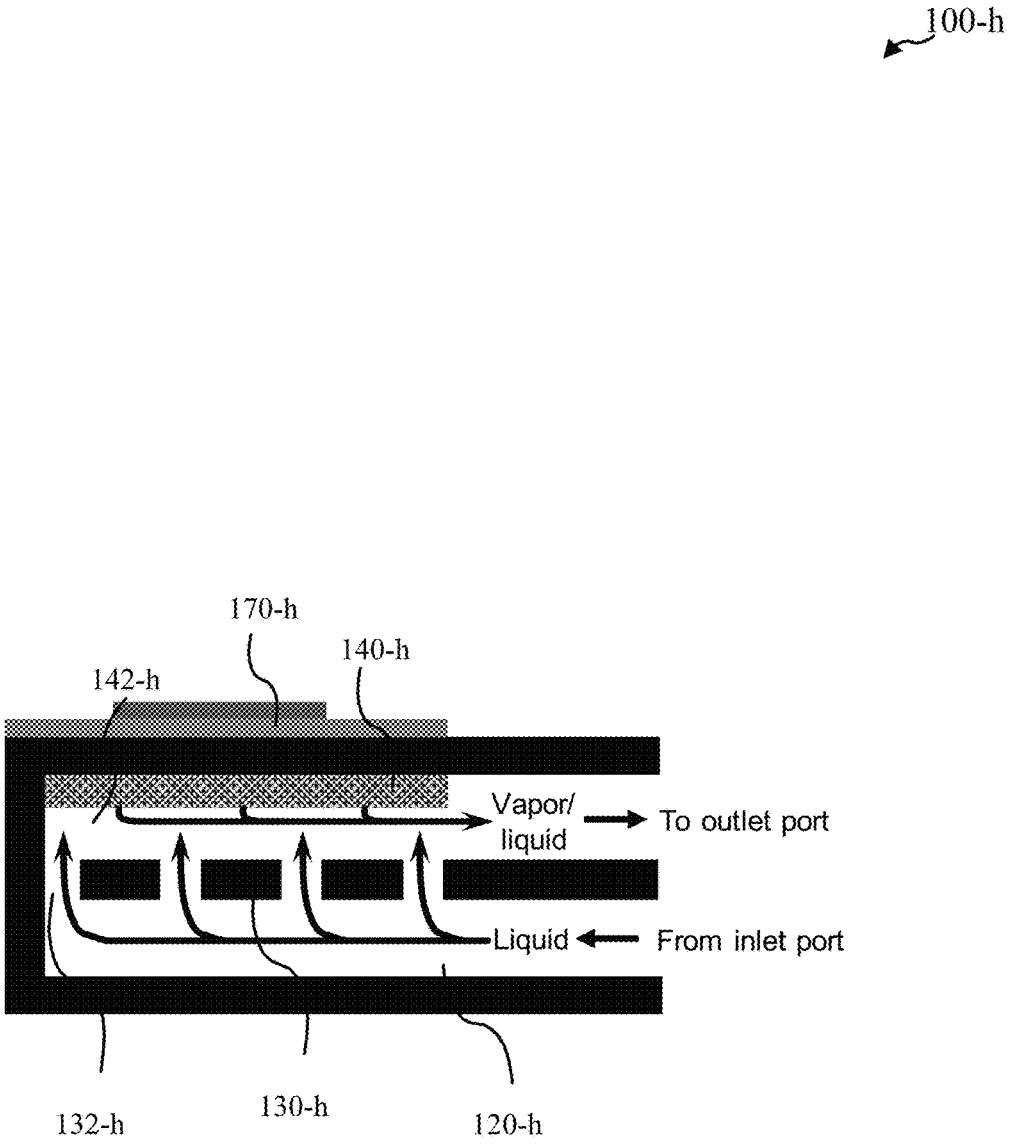
FIG. 6D shows a system and/or device in accordance with various embodiments.

FIG. 6D highlights a portion of device 100-*h* to show some of the operating principles of the device. Liquid may be introduced into the liquid chamber 120-*h* and then be directed through the multiple nozzles or apertures 132-*h* of the liquid manifold 130-*h*. The liquid may be jet impinged upon the capillary layer 140-*h* within evaporator chamber 142-*h*. The jet velocity and gap height between the liquid manifold 130-*h* and the capillary layer 140-*h* may provide for variable heat transfer. Jets of liquid may provide for increase liquid velocity at the heated surface. Heat from a heat source 170-*h*, such as a diode, may be absorbed through the capillary layer 140-*h* and liquid, which may form a vapor. The vapor and remaining liquid may exit the device through an outlet port. Furthermore, the two-phase thermal management device 100-*h* may take advantage of boiling heat transfer; some embodiments may be configured such that the liquid that is jet impinged or otherwise delivered to the capillary layer 140-*h* may be heated to a boiling point of the liquid or near the boiling point of the liquid.

The use of capillary layer 140-*h* may provide for a micro-structured evaporator with multiple purposes. For example, the capillary layer 140-*h* may provide increased surface area. Some embodiments may introduce etched or pitted features that may promote vapor bubble nucleation and may also provide lateral has three-fold purpose capillary forces that may maintain liquid distribution, which may facilitate temperature uniformity and stability under dynamic accelerations. In some embodiments, the capillary layer 140-*h* may include a mesh, a foam, a woven screen, and/or pin fins, for example.

Figure 7A:
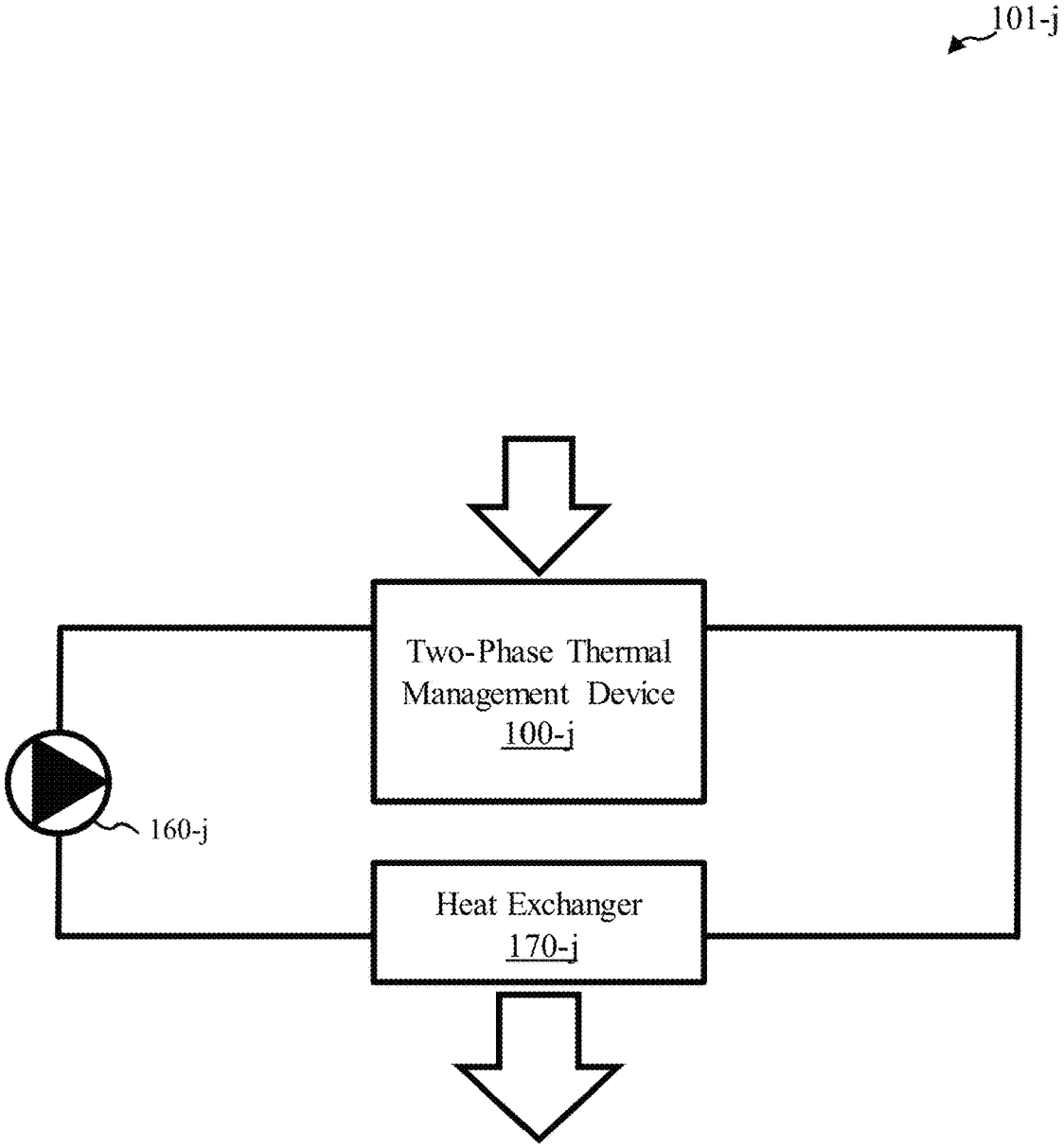
FIG. 7A shows a system and/or device in accordance with various embodiments.

Turning now to FIG. 7A, a two-phase thermal management system 101-*j* in accordance with various embodiments is provided. System 100-*j* may be an example of system 101 of FIG. 1B, FIG. 1C, FIG. 1D, and/or FIG. 3D, for example.

System 101-*j* may include a two-phase thermal management device 100-*j*, which may be an example of device 100 of FIG. 1A, FIG. 1B, FIG. 1C, FIG. 1D, FIG. 2, FIG. 3, FIG. 4A, FIG. 4B, FIG. 4C, FIG. 5A, FIG. 5B, FIG. 5C, FIG. 5D, FIG. 6A, FIG. 6B, FIG. 6C, and/or FIG. 6D. Device 100-*j* may be coupled with a heat exchanger 170-*j* such that vapor from the device 100-*j* may be condensed and reform a liquid. System 101-*j* may also include a pump 160-*j* or other means for delivering the liquid to the device 100-*j*, such as a gravity reservoir. System 101—may include other components, not shown but discussed elsewhere herein, such as a pre-heater, a heat recuperator, and/or a variable-volume reservoir or other means for facilitating keeping the liquid at a constant pressure and/or temperature with respect to a boiling point of the liquid. As noted with the arrows, heat may be absorbed from a heat source, for example, by the two-phase thermal management device 100-*j*; the heat exchanger 170-*j* may then dump heat it has removed from the vapor.

Figure 7B:
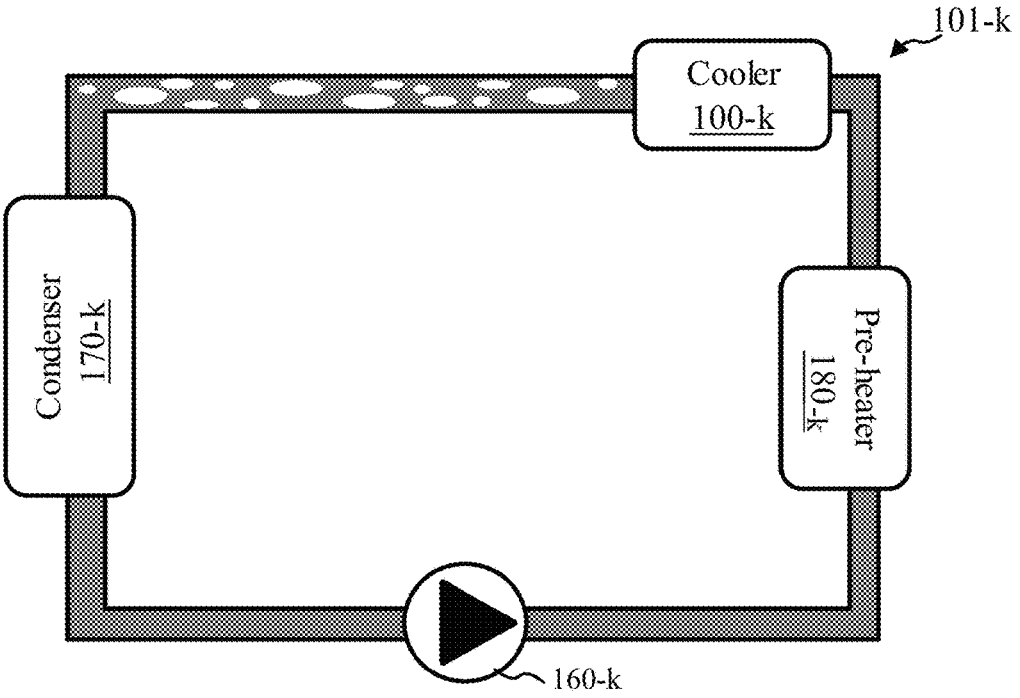
FIG. 7B shows a system and/or device in accordance with various embodiments.

FIG. 7B shows another example of a two-phase thermal management system 101-*k* in accordance with various embodiments is provided. System 101-*k* may be an example of system 101 of FIG. 1B, FIG. 1C, FIG. 1D, FIG. 3, and/or FIG. 7A. System 101-*k* may include cooler 100-*k*, which may be an example of a two-phase thermal management device. Cooler 100-*k* may be an example of device 100 of FIG. 1A, FIG. 1B, FIG. 1C, FIG. 1D, FIG. 2, FIG. 3, FIG. 4A, FIG. 4B, FIG. 4C, FIG. 5A, FIG. 5B, FIG. 5C, FIG. 5D, FIG. 6A, FIG. 6B, FIG. 6C, FIG. 6D, and/or FIG. 7A. Cooler 100-*k* may be coupled with a condenser 170-*k* such that vapor from the cooler 100-*k* may be condensed and reform a liquid. The collection of vapor and/or liquid between the cooler 160-*k* and the condenser 170-*k* may result in volume change; this volume change may be taken into account in order to maintain a constant pressure and/or constant temperature with respect to a boiling point of the liquid in some embodiments, as will be discussed below.

System 101-*k* may also include a pump 160-*k* or other means for delivering the liquid to the cooler 100-*k*, such as a gravity reservoir. System 100-*k* may include a pre-heater 180-*k*. Pre-heater 180-*k* may be configured to heat the liquid prior to the liquid being delivered to the one or more inlets of the cooler 100-*k*. The pre-heater 180-*k* may be configured to heat the liquid up to a boiling point of the liquid.

System 101-*k* may include other components, not shown but discussed elsewhere herein, such as a heat recuperator and/or a variable-volume reservoir or other means for facilitating keeping the liquid at a constant pressure and/or temperature with respect to a boiling point of the liquid.

Figure 7C:
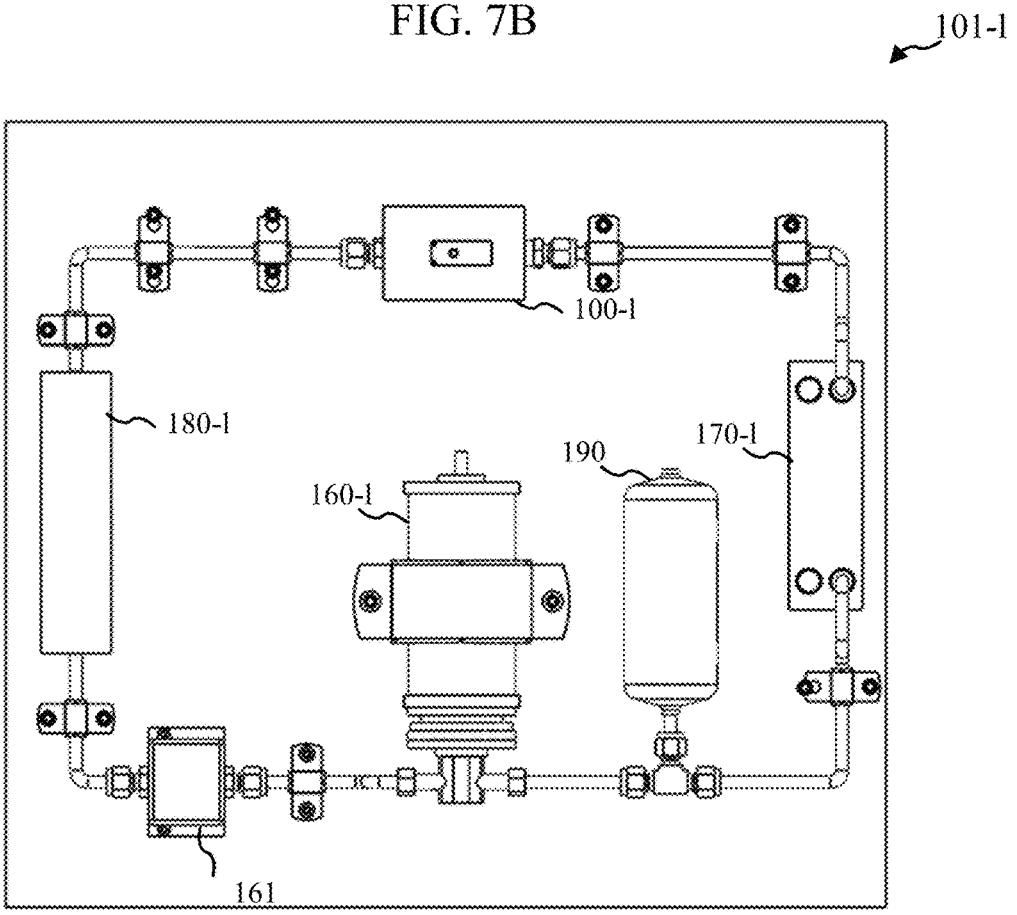
FIG. 7C shows a system and/or device in accordance with various embodiments.

Turning now to FIG. 7C, a two-phase thermal management system 101-*l* is provided in accordance with various embodiments. System 101-*l* may be an example of system 100 of FIG. 1B, FIG. 1C, FIG. 1D, FIG. 3, FIG. 7A, and/or FIG. 7B. System 101-*l* may include a two-phase thermal management device 100-*l*, which may be an example of device 100 of FIG. 1A, FIG. 1B, FIG. 1C, FIG. 1D, FIG. 2, FIG. 3, FIG. 4A, FIG. 4B, FIG. 4C, FIG. 5A, FIG. 5B, FIG. 5C, FIG. 5D, FIG. 6A, FIG. 6B, FIG. 6C, FIG. 6D, FIG. 7A, and/or FIG. 7B. System 100-*l* may include a condenser 170-*l* or heat exchanger coupled with the one or more outlets of the two-phase thermal management device 100-*l* to receive vapor from the two-phase thermal management device 100-*l* and reform the liquid.

System 101-*l* may include a variable-volume reservoir 190, which may be coupled with the two-phase thermal management device 100-*l* such at least at a constant temperature or a constant pressure is maintained with respect to a boiling point of the liquid. For example, the reservoir 190 may be configured to change volume to compensate for changes within system 100-*l* through apply a constant force and/or pressure through the reservoir 190. Reservoir 190 may be configured as a bellows and/or accumulator in some embodiments. FIG. 7E shows an example of a variable-volume reservoir 190-*n*, where pressure may be applied to system 100-*l* through a spring force being applied the plunger housed with a spring within a housing.

System 100-*l* may also include a pump 160-*l* that may be configured to pump the liquid to the two-phase thermal management device 100-*l*. Some embodiments may include a flow meter 161. System 100-*l* may also include a pre-heater 180-*l* that may be configured to heat the liquid prior to the liquid being delivered to the one or more inlets of the two-phase thermal management device 100-*l*. The pre-heater 180-*l* may be configured to heat the liquid up to a boiling point of the liquid.

Figure 7D:
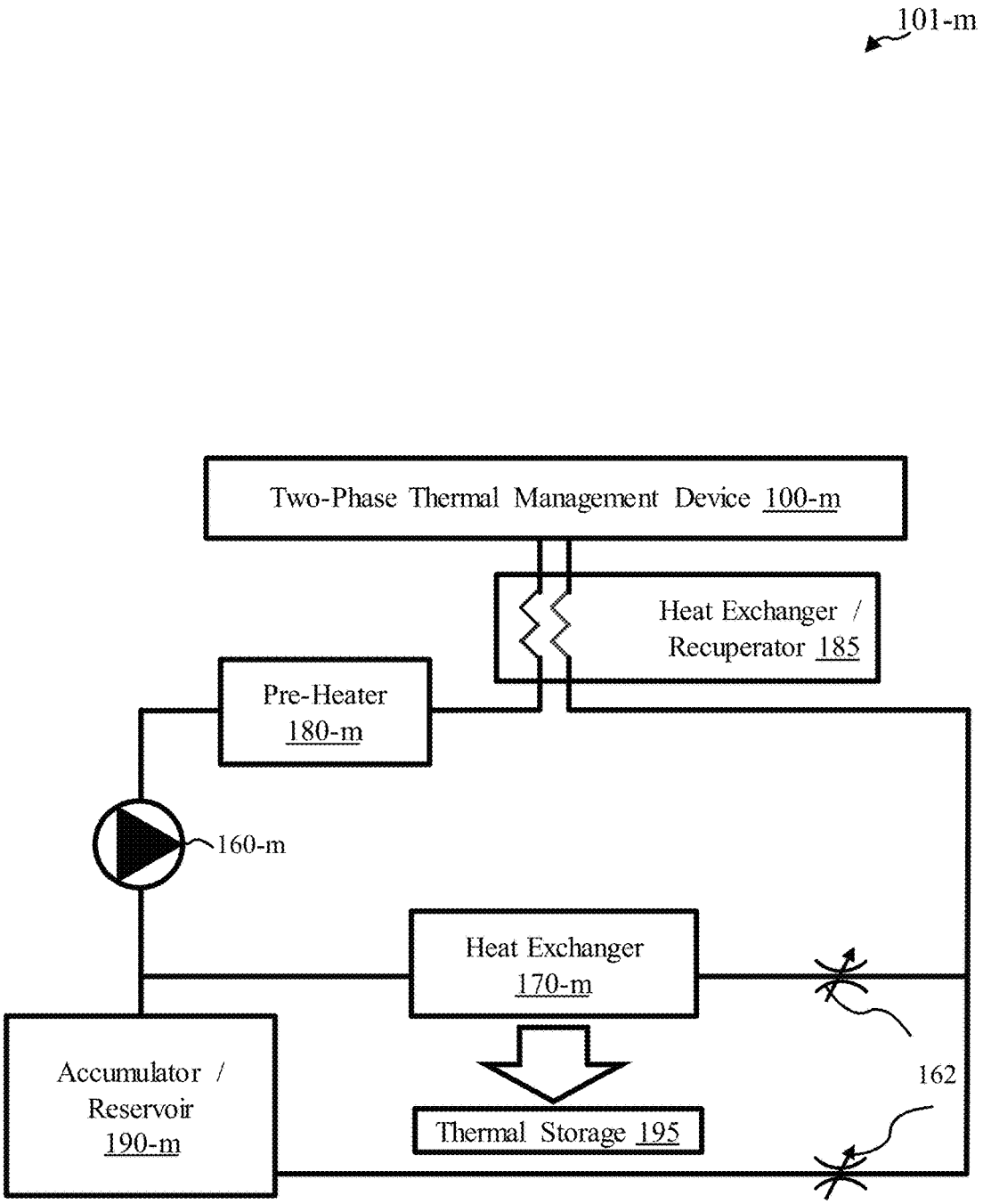
FIG. 7D shows a system and/or device in accordance with various embodiments.
Figure 7E:
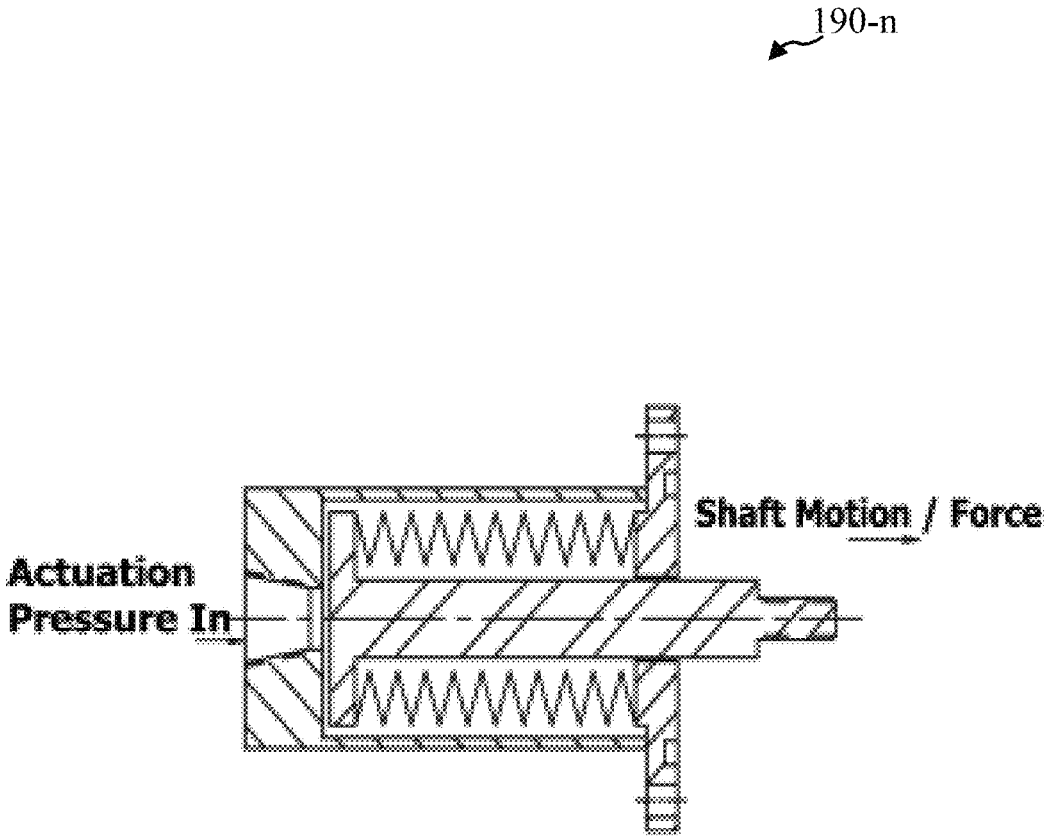
FIG. 7E shows a system component in accordance with various embodiments.

FIG. 7D provides another two-phase thermal management system 101-*m* in accordance with various embodiments. System 101-*m* may be an example of system 100 of FIG. 1B, FIG. 1C, FIG. 3, FIG. 7A, FIG. 7B, and/or FIG. 7C. System 101-*m* may include a two-phase thermal management device 100-*m*, which may be an example of device 100 of FIG. 1A, FIG. 1B, FIG. 1C, FIG. 1D, FIG. 2, FIG. 3, FIG. 4A, FIG. 4B, FIG. 4C, FIG. 5A, FIG. 5B, FIG. 5C, FIG. 5D, FIG. 6A, FIG. 6B, FIG. 6C, FIG. 6D, FIG. 7A, FIG. 7B, and/or FIG. 7C.

System 101-*m* may include a heat exchanger 170-*m* or condenser coupled with the one or more outlets of the two-phase thermal management device 100-*m* to receive vapor from the two-phase thermal management device 100-*m* and reform the liquid.

System 101-*m* may include a variable-volume reservoir 190-*m* or accumulator, which may be coupled with the two-phase thermal management device 100-*m* such at least at a constant temperature or a constant pressure is maintained with respect to a boiling point of the liquid. For example, the reservoir or accumulator 190-*m* may be configured to change volume to compensate for changes within system 100-*m* through apply a constant force and/or pressure through the reservoir or accumulator 190-*m*. Reservoir or accumulator 190-*m* may be configured as a bellows and/or actuator in some embodiments.

System 100-*m* may also include a pump 160-*m* that may be configured to pump the liquid to the two-phase thermal management device 100-*m*. The pump 160-*m* may be configured to provide a variable flow rate for the system 100-*m*. Some embodiments may include one or more throttle valves 162, which may control flow to the heat exchanger 170-*m* and/or accumulator/reservoir 190-*m*.

System 100-*m* may also include a pre-heater 180-*m* that may be configured to heat the liquid prior to the liquid being delivered to the one or more inlets of the two-phase thermal management device 100-*m*. The pre-heater 180-*m* may be configured to heat the liquid up to a boiling point of the liquid. Some embodiments may utilize a heat recuperator 185 or heat exchanger configured to remove heat from the vapor coming from the two-phase thermal device 100-*m* and heating the liquid being introduced into the two-phase thermal management device 100-*m*. In some embodiments, the recuperator 185 may be utilized in place of the pre-heater 180-*m*, while in other embodiments it may be utilized on conjunction with the pre-heater 180-*m*.

System 100-*m* may include a thermal storage 195 that may be configured to store heat from at least the heat exchanger 170-*m* or the heat recuperator 185. In some embodiments, the thermal storage includes a phase-change material. Thermal storage 195 may be coupled with system 100-*m* such that heat stored within thermal storage 195 may be utilized to pre-heat the liquid before being introduced into device 100-*m*; in some embodiments, heat from thermal storage 195 may be utilized to heat other components.

Figure 8A:
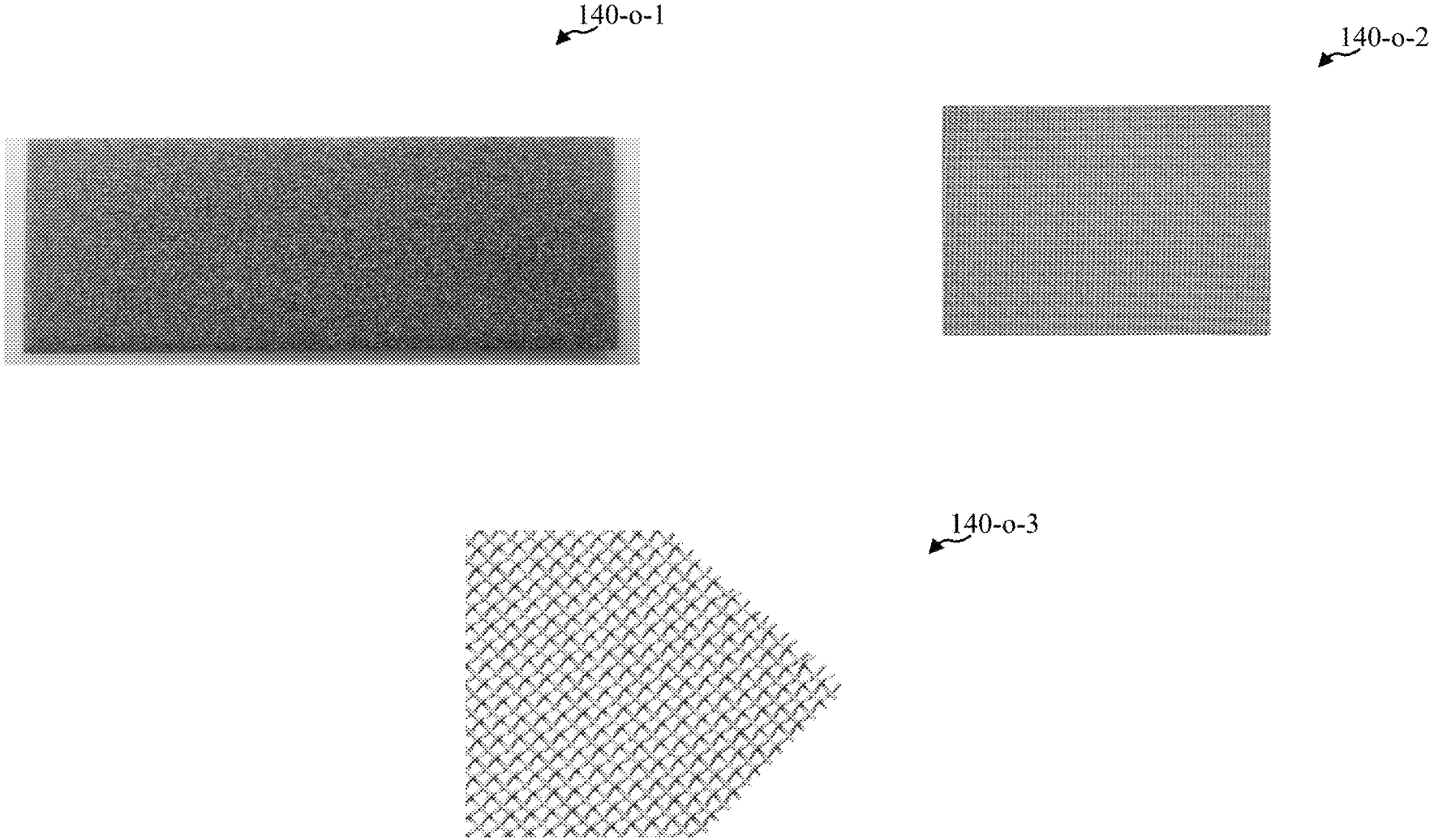
FIG. 8A shows device components in accordance with various embodiments.
Figure 8B:
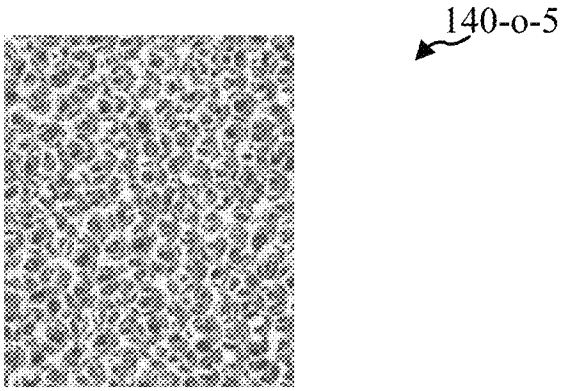
FIG. 8B shows device components in accordance with various embodiments.

FIG. 8A and FIG. 8B show different examples of capillary layers 140-*o* that may be utilized in the variety of different two-phase thermal management devices 100 disclosed herein. For example, capillary layer 140-*o*-1 may show an example of a foam, such as a copper foam, while capillary layer 140-*o*-2 may show an example of a mesh and capillary layer 140-*o*-3 may show a woven screen, which may be made of copper or other materials. Capillary layer 140-*o*-4 may show an example of a pin fin configuration. Capillary layer 140-*o*-5 may show an example of a textured surface; in some embodiments, the textured surface may be formed from a surface treatment. In some cases, the capillary layer 140 may include a portion of an external layer of the two-phase thermal management device, such as examples 140-*o*-4 and 140-*o*-5. In some cases, the external layer may include a metal foil. In some embodiments, a surface treatment may be applied to the variety of different capillary layers 140.

The capillary layers 140 may provide examples of microstructures. In some embodiments, the foam, mesh, woven screen, pin fins, or textured surface may be formed from copper or other metals. Some capillary layers in accordance with various embodiments may include a 3-D amorphous microstructure that may wick the working fluid without causing flow-boiling instabilities. In some embodiments, the capillary layer and/or other layers, such as an inside surface of an external layer proximal to a heat surface, may be treated with different surface treatments to improve wicking. For example, omni-philic surface treatments may reduce the contact angle of the working fluid with the surface of the capillary layer, which may improve wicking. Surface treatment may also form nanopores into the surface of the capillary layer material, which may increase the surface area at the micro and nano scales. This may aid in bubble nucleation and separation. Surface treatment may in general involve mechanical polishing and/or etching. Micro and/or nanopore cavities on surfaces may be formed that may promote wetting of the working fluid.

Figure 9A:
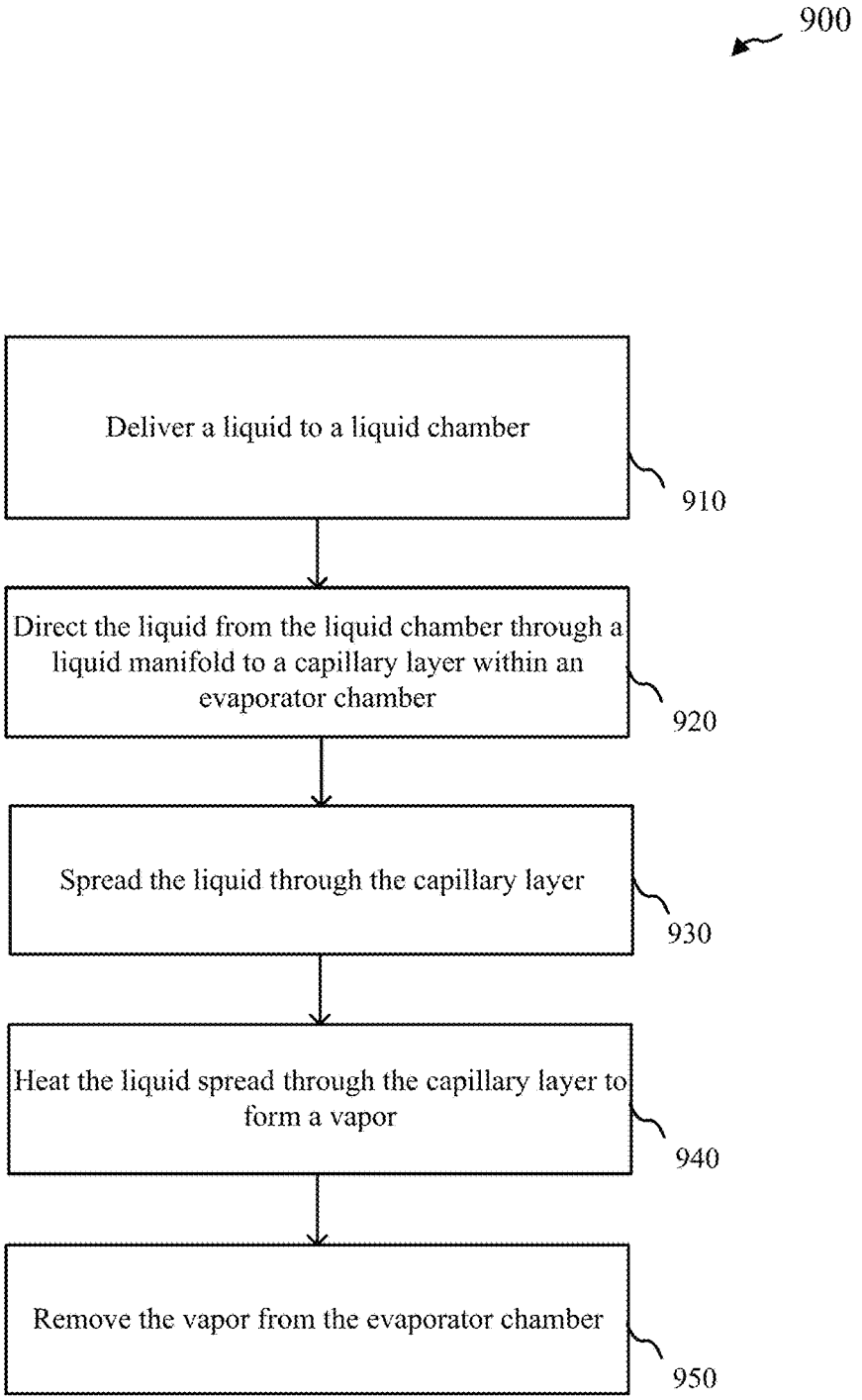
FIG. 9A shows a flow diagram of a method in accordance with various embodiments.

Turning now to FIG. 9A, a flow diagram of a method 900 is shown in accordance with various embodiments. Method 900 may be implemented utilizing a variety of systems and/or devices such as those shown and/or described with respect to FIG. 1A, FIG. 1B, FIG. 1C, FIG. 1D, FIG. 2, FIG. 3, FIG. 4A, FIG. 4B, FIG. 4C, FIG. 5A, FIG. 5B, FIG. 5C, FIG. 5D, FIG. 6A, FIG. 6B, FIG. 6C, FIG. 6D, FIG. 7A, FIG. 7B, FIG. 7C, FIG. 7D, FIG. 7E, FIG. 8A, and/or FIG. 8B.

At block 910, a liquid may be delivered to a liquid chamber. At block 920, the liquid may be directed from the liquid chamber through a liquid manifold to a capillary layer within an evaporator chamber. At block 930, the liquid may be spread through the capillary layer. At block 940, the liquid spread through the capillary layer may be heated to form a vapor. At block 950, the vapor may be removed from the evaporator chamber.

Some embodiments of method 900 include condensing the vapor to form a reformed liquid. Some embodiments include circulating the reformed liquid back to the liquid chamber.

Some embodiments of method 900 include maintaining at least a constant pressure or a constant temperature with respect to a boiling point of the liquid. Maintaining at least the constant pressure or the constant temperature may include utilizing a variable volume reservoir.

Some embodiments of method 900 include preheating the liquid prior to delivering the liquid to the liquid chamber. Preheating the liquid may include passing the vapor through a heat recuperator to remove heat from the vapor and heat the liquid prior to delivering the liquid to the liquid chamber.

In some embodiments of method 900, delivering the liquid to the liquid chamber includes pumping the liquid to deliver the liquid to the liquid chamber. In some embodiments, delivering the liquid to the liquid chamber includes utilizing gravity to deliver the liquid to the liquid chamber.

Some embodiments of method 900 include coupling a heat source with the evaporator chamber proximal to the capillary layer.

Figure 9B:
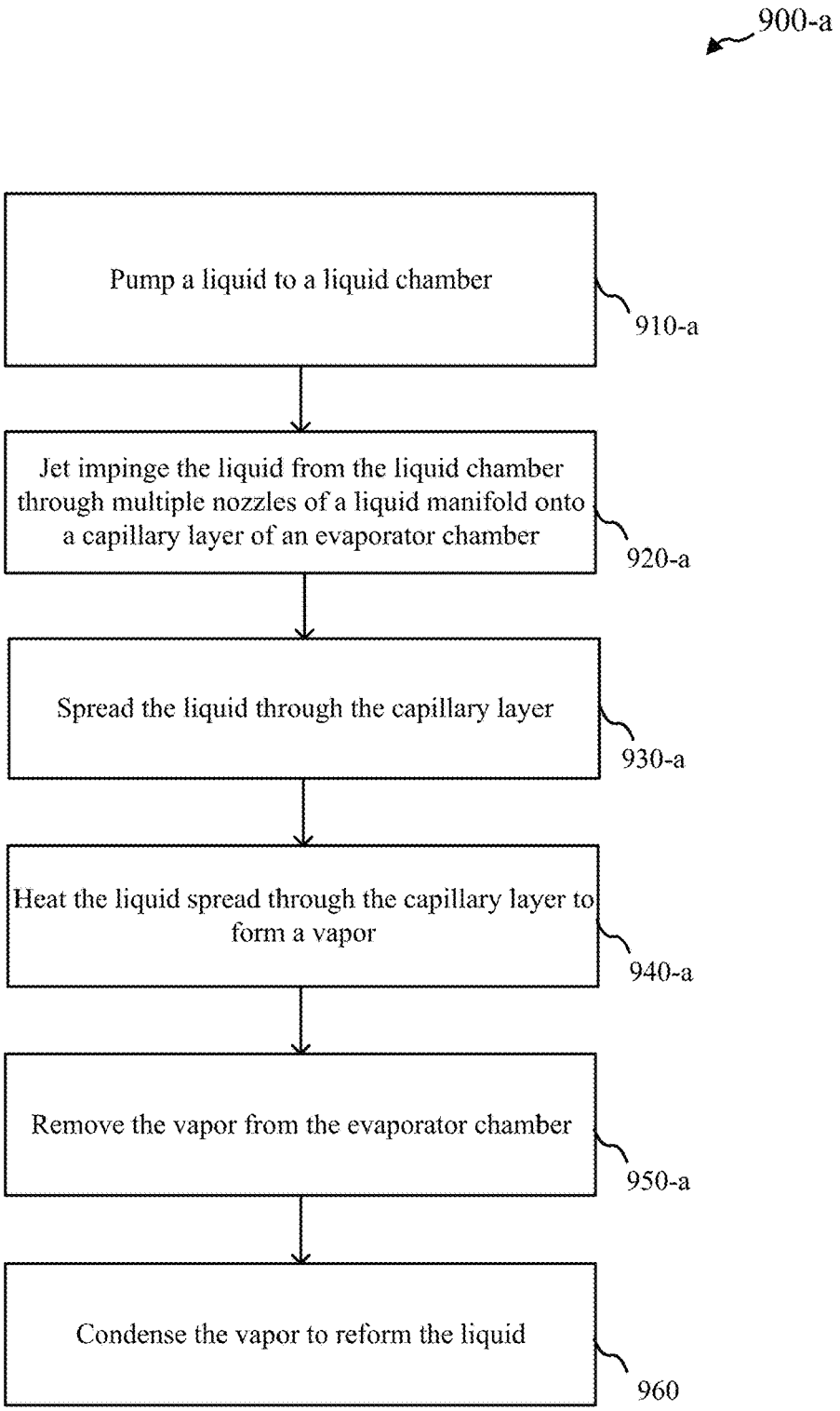
FIG. 9B shows a flow diagram of a method in accordance with various embodiments.

FIG. 9B shows flow diagram of a method 900-*a* in accordance with various embodiments. Method 900-*a* may be implemented utilizing a variety of systems and/or devices such as those shown and/or described with respect to FIG. 1A, FIG. 1B, FIG. 1C, FIG. 1D, FIG. 2, FIG. 3, FIG. 4A, FIG. 4B, FIG. 4C, FIG. 5A, FIG. 5B, FIG. 5C, FIG. 5D, FIG. 6A, FIG. 6B, FIG. 6C, FIG. 6D, FIG. 7A, FIG. 7B, FIG. 7C, FIG. 7D, FIG. 7E, FIG. 8A, and/or FIG. 8B. Method 900-*a* may be an example of method 900 of FIG. 9A.

At block 910-*a*, a liquid may be pumped to a liquid chamber. At block 920-*a*, the liquid from the liquid chamber may be jet impinged through multiple nozzles of a liquid manifold onto a capillary layer of an evaporator chamber. At block 930-*a*, the liquid may be spread through the capillary layer. At block 940-*a*, the liquid spread through the capillary layer may be heated to form a vapor. At block 950-*a*, the vapor may be removed from the evaporator chamber. At block 960, the vapor may be condensed to reform the liquid.

Figure 8B:
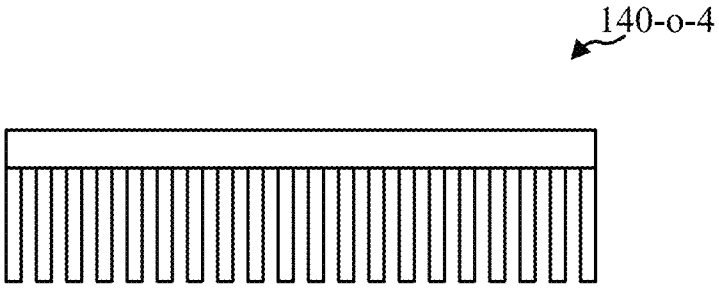
Figure 9C:
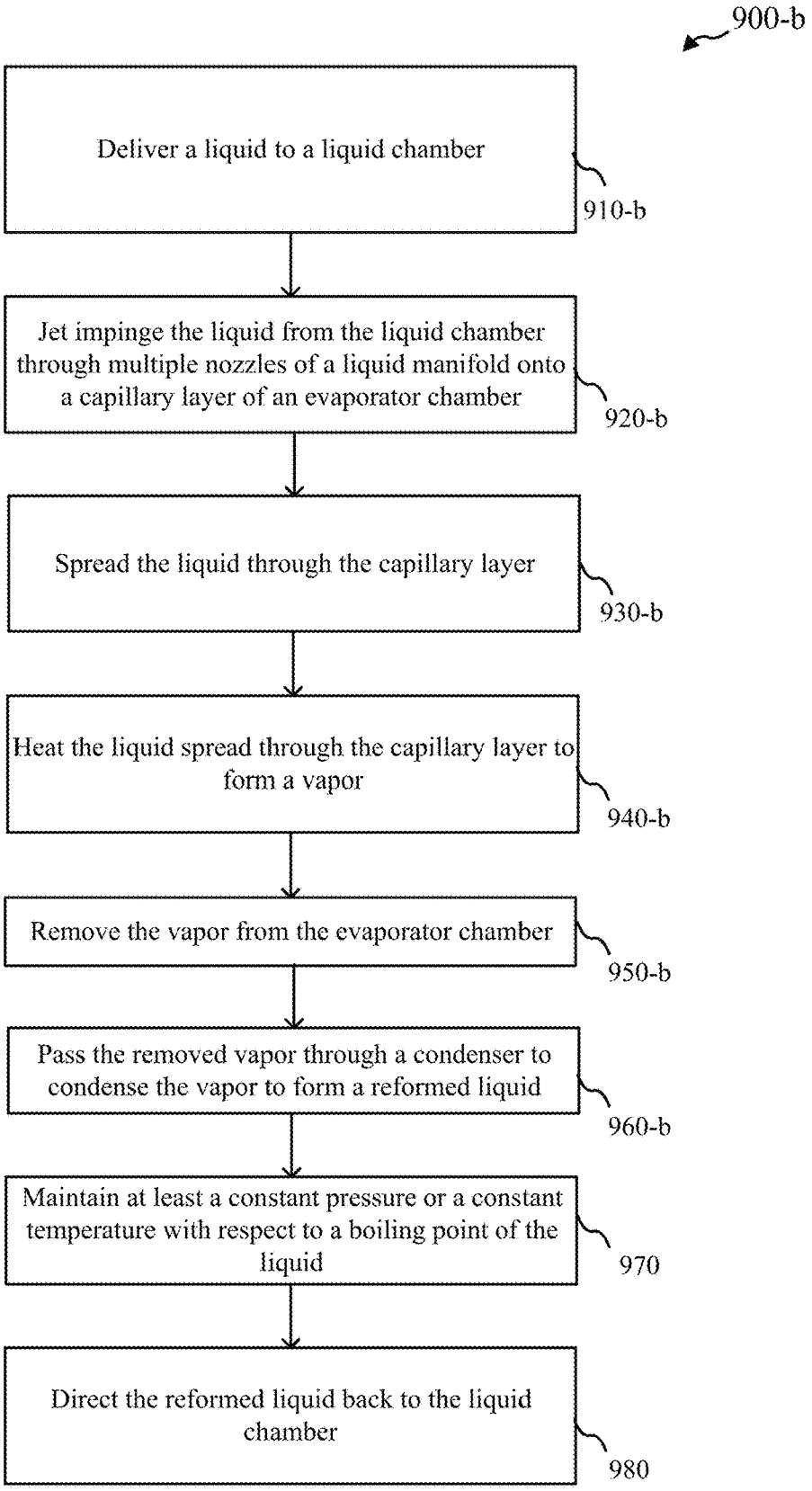
FIG. 9C shows a flow diagram of a method in accordance with various embodiments.

FIG. 9C shows flow diagram of a method 900-*b* in accordance with various embodiments. Method 900-*b* may be implemented utilizing a variety of systems and/or devices such as those shown and/or described with respect to FIG. 1A, FIG. 1B, FIG. 1C, FIG. 1D, FIG. 2, FIG. 3, FIG. 4A, FIG. 4B, FIG. 4C, FIG. 5A, FIG. 5B, FIG. 5C, FIG. 5D, FIG. 6A, FIG. 6B, FIG. 6C, FIG. 6D, FIG. 7A, FIG. 7B, FIG. 7C, FIG. 7D, FIG. 7E, and/or FIG. 8. Method 900-*b* may be an example of method 900 of FIG. 9A and/or method 900-*a* of FIG. 9B.

At block 910-*b*, a liquid may be delivered to a liquid chamber. At block 920-*b*, the liquid from the liquid chamber may be jet impinged through multiple nozzles of a liquid manifold onto a capillary layer of an evaporator chamber. At block 930-*b*, the liquid may be spread through the capillary layer. At block 940-*b*, the liquid spread through the capillary layer may be heated to form a vapor. At block 950-*b*, the vapor may be removed from the evaporator chamber. At block 960-*b*, the vapor may be passed through a condenser to condense the vapor to form a reformed liquid. At block 970, at least a constant pressure or a constant temperature may be maintained with respect to a boiling point of at least the liquid. At block 980, the reformed liquid may be directed back to the liquid chamber.

Figure 9D:
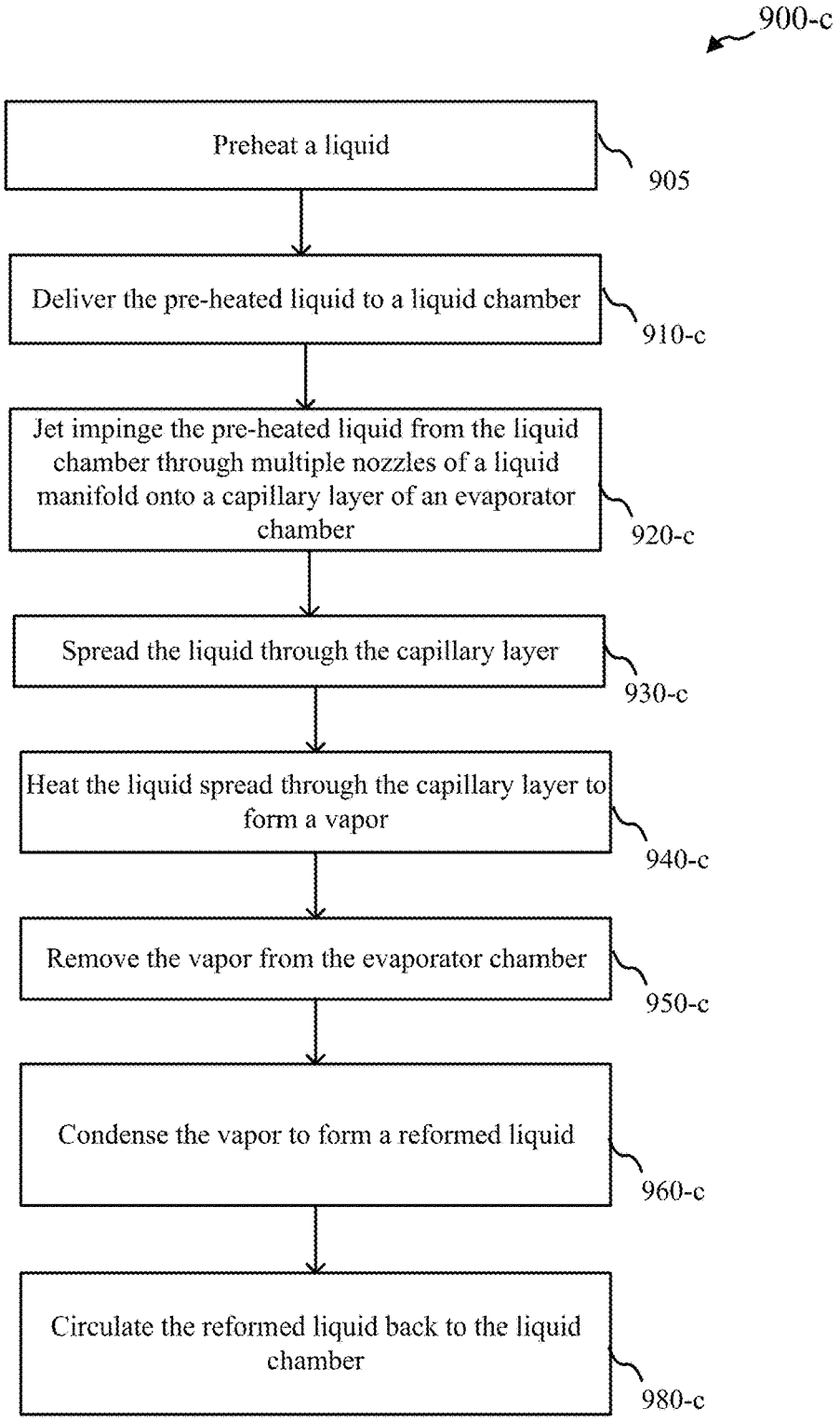
FIG. 9D shows a flow diagram of a method in accordance with various embodiments.

FIG. 9D shows flow diagram of a method 900-*c* in accordance with various embodiments. Method 900-*c* may be implemented utilizing a variety of systems and/or devices such as those shown and/or described with respect to FIG. 1A, FIG. 1B, FIG. 1C, FIG. 1D, FIG. 2, FIG. 3, FIG. 4A, FIG. 4B, FIG. 4C, FIG. 5A, FIG. 5B, FIG. 5C, FIG. 5D, FIG. 6A, FIG. 6B, FIG. 6C, FIG. 6D, FIG. 7A, FIG. 7B, FIG. 7C, FIG. 7D, FIG. 7E, FIG. 8A, and/or FIG. 8B. Method 900-*c* may be an example of method 900 of FIG. 9A, method 900-*a* of FIG. 9B, and/or method 900-*b* of FIG. 9C.

At block 905, a liquid may be preheated. At block 910-*c*, a liquid may be delivered to a liquid chamber. At block 920-*c*, the liquid from the liquid chamber may be jet impinged through multiple nozzles of a liquid manifold onto a capillary layer of an evaporator chamber. At block 930-*c* the liquid may be spread through the capillary layer. At block 940-*c*, the liquid spread through the capillary layer may be heated to form a vapor. At block 950-*c*, the vapor may be removed from the evaporator chamber. At block 960-*c*, the vapor may be condensed to form a reformed liquid. At block 980-*c*, the reformed liquid may be circulated back to the liquid chamber.

In some embodiments, a pre-heater may preheat the liquid at block 905. In some embodiments, a heat recuperator may pre-heat the liquid, where the heat recuperator captures heat from the vapor as it is condensed to reform the liquid.

These embodiments may not capture the full extent of combination and permutations of materials and process equipment. However, they may demonstrate the range of applicability of the method, devices, and/or systems. The different embodiments may utilize more or less stages than those described.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various stages may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which may be depicted as a flow diagram or block diagram or as stages. Although each may describe the operations as a sequential process, many of the operations can be performed in parallel or concurrently. In addition, the order of the operations may be rearranged. A process may have additional stages not included in the figure.

Having described several embodiments, it will be recognized by those of skill in the art that various modifications, alternative constructions, and equivalents may be used without departing from the spirit of the different embodiments. For example, the above elements may merely be a component of a larger system, wherein other rules may take precedence over or otherwise modify the application of the different embodiments. Also, a number of stages may be undertaken before, during, or after the above elements are considered. Accordingly, the above description should not be taken as limiting the scope of the different embodiments.

What is claimed is:

1. A two-phase thermal management device comprising:
a liquid chamber;
one or more inlets configured to deliver a liquid to the liquid chamber;
an evaporator chamber;
a capillary layer positioned within the evaporator chamber and configured to spread the liquid from the liquid chamber;
a liquid manifold configured to deliver the liquid from the liquid chamber to the capillary layer through a plurality of apertures through the liquid manifold, wherein:
the capillary layer is positioned between a heat source coupled with the two-phase thermal management device and the plurality of apertures of the liquid manifold; and
the liquid impinges onto the capillary layer from the plurality of apertures at angles normal to the capillary layer positioned between the plurality of apertures of the liquid manifold and the heat source; and
one or more outlets configured to remove at least a vapor or a portion of the liquid from the evaporator chamber.

2. The device of claim 1, wherein the capillary layer includes one or more microstructures.

3. The method of claim 2, wherein the one or more microstructures include a wicking structure.

4. The device of claim 3, wherein the wicking structure includes at least a woven screen, a mesh, or a foam.

5. The device of claim 1, wherein the plurality of apertures include a plurality of nozzles.

6. The device of claim 1, wherein the liquid manifold includes a flat plate with a plurality of pin holes as the plurality of apertures.

7. The device of claim 1, wherein the liquid manifold includes at least one or more tubes or one or more capillary channels as the plurality of apertures configured to deliver the liquid from the liquid chamber to the capillary layer.

8. The device of claim 1, further comprising one or more pumps coupled with at least the one or more inlets or the one or more outlets.

9. The device of claim 1, further comprising one or more gravity reservoirs coupled with at least the one or more inlets such that the liquid is gravity fed to the one or more inlets.

10. The device of claim 2, wherein the one or more microstructures are bonded to an interior side of an external layer of the two-phase thermal management device, wherein the external layer is configured to couple with the heat source.

11. The device of claim 1, wherein the one or more outlets are configured as diverging outlets to allow the vapor to expand from the two-phase thermal management device.

12. The device of claim 1, wherein the capillary layer includes an external layer formed from a metal foil.

13. The device of claim 1, wherein the capillary layer includes a textured surface.

14. The device of claim 1, wherein the capillary layer includes a plurality of pin fins.

15. The device of claim 1, further comprising the heat source coupled to the external layer of the two-phase thermal management device.

16. The device of claim 3, wherein the wicking structure includes a surface treatment of an interior surface of an external layer of the two-phase thermal management device.

17. The device of claim 1, further comprising a variable-volume reservoir coupled with at least the one or more inlets or the one or more outlets such that at least a constant pressure or a constant temperature is maintained with respect to a boiling point of the liquid.

18. A two-phase thermal management method comprising:
delivering a liquid to a liquid chamber;
directing the liquid from the liquid chamber through a liquid manifold to a capillary layer within an evaporator chamber through a plurality of apertures through the liquid manifold, wherein:
the capillary layer is positioned between a heat source and the plurality of apertures of the liquid manifold; and
the liquid impinges onto the capillary layer from the plurality of apertures at angles normal to the capillary layer positioned between the plurality of apertures of the liquid manifold and the heat source;
spreading the liquid through the capillary layer;
heating the liquid spread through the capillary layer to form a vapor; and
removing the vapor from the evaporator chamber.

* * * * *